US011162668B2

(12) United States Patent
Manulik et al.

(10) Patent No.: US 11,162,668 B2
(45) Date of Patent: Nov. 2, 2021

(54) HANGING LIGHT

(71) Applicant: MILWAUKEE ELECTRIC TOOL CORPORATION, Brookfield, WI (US)

(72) Inventors: Sara M. Manulik, Milwaukee, WI (US); Duane W. Wenzel, Waukesha, WI (US); Michael A. Matthews, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 166 days.

(21) Appl. No.: 16/659,743

(22) Filed: Oct. 22, 2019

(65) Prior Publication Data

US 2020/0124256 A1 Apr. 23, 2020

Related U.S. Application Data

(60) Provisional application No. 62/749,181, filed on Oct. 23, 2018.

(51) Int. Cl.
*F21V 21/008* (2006.01)
*F21L 14/02* (2006.01)
(Continued)

(52) U.S. Cl.
CPC ..... *F21V 21/008* (2013.01); *F21L 14/02* (2013.01); *F21V 21/16* (2013.01); *F21Y 2115/10* (2016.08)

(58) Field of Classification Search
CPC ..... F21L 14/02; F21V 21/008; F21V 21/16
See application file for complete search history.

(56) References Cited

U.S. PATENT DOCUMENTS 2,156,742 A 5/1939 Shellabarger
2,627,834 A 2/1953 Roberts et al.
(Continued)

FOREIGN PATENT DOCUMENTS

GB 2263726 8/1993

OTHER PUBLICATIONS

Construction Electrical Products, "LED High Bay Light", Accessed: Mar. 9, 2016, <http://www.cepnow.com/product/led-high-bay-light/>.

(Continued)

*Primary Examiner* — Leah Simone Macchiarolo
(74) *Attorney, Agent, or Firm* — Michael Best & Friedrich LLP

(57) ABSTRACT

A portable lighting device includes a body having an interior cavity, a lighting unit supported by the body including a light emitting diode, and a terminal block supported within the interior cavity of the body. The terminal block configured to connect to a power source and provide electrical energy to the lighting unit to illuminate the light emitting diode. The portable lighting device also includes a port formed in the body in communication with the interior cavity. The port configured to allow an electrical wire to pass into the interior cavity to couple the electrical wire to the terminal block. The portable lighting unit further includes a wire clamp supported by the body at the port. The wire clamp includes a single actuator and a clamp. The single actuator is selectively movable relative to the body to move the clamp into engagement with the electrical wire passing through the port.

20 Claims, 27 Drawing Sheets

(51) Int. Cl.
*F21V 21/16* (2006.01)
*F21Y 115/10* (2016.01)

(56) References Cited

U.S. PATENT DOCUMENTS

| | | | |
|---|---|---|---|
| 2,836,870 | A | 6/1958 | Shea |
| 3,265,032 | A | 8/1966 | Hume |
| 3,730,129 | A | 5/1973 | Helms |
| 3,765,061 | A | 10/1973 | Nash |
| 3,795,218 | A | 3/1974 | Merry |
| 4,217,847 | A | 8/1980 | McCloud |
| 4,397,253 | A | 8/1983 | Uecker et al. |
| 4,453,486 | A | 6/1984 | Harken |
| 4,841,420 | A | 6/1989 | Baggio et al. |
| 4,956,897 | A | 9/1990 | Speedie |
| 5,403,976 | A | 4/1995 | Maurice |
| D391,000 | S | 2/1998 | Markee |
| 6,003,210 | A | 12/1999 | Facey et al. |
| 6,234,653 | B1 | 5/2001 | Karton |
| 6,296,369 | B1 | 10/2001 | Liao |
| D464,454 | S | 10/2002 | Suzuki et al. |
| 6,517,222 | B1 | 2/2003 | Orlov |
| 6,761,342 | B1 | 7/2004 | Giefer et al. |
| 6,767,116 | B2 | 7/2004 | Lupicki |
| 6,767,117 | B2 | 7/2004 | De'Armond |
| 7,019,210 | B2 | 3/2006 | Radin |
| 7,287,304 | B2 | 10/2007 | Zebe, Jr. |
| 7,347,582 | B1 | 3/2008 | Kung |
| D565,766 | S | 4/2008 | Shiu |
| D572,852 | S | 7/2008 | Niven |
| D574,993 | S | 8/2008 | Silver |
| 7,784,964 | B2 | 8/2010 | Yen |
| 7,866,850 | B2 | 1/2011 | Alexander et al. |
| 8,164,237 | B2 | 4/2012 | Wen |
| D711,572 | S | 8/2014 | Kwon et al. |
| 9,028,112 | B2 | 5/2015 | Ellenburg et al. |
| 9,033,550 | B1 | 5/2015 | Tickner |
| D759,284 | S | 6/2016 | De Bevilacqua et al. |
| 9,447,934 | B2 | 9/2016 | Kim |
| D773,703 | S | 12/2016 | Krantz et al. |
| D773,704 | S | 12/2016 | Pardo et al. |
| D773,705 | S | 12/2016 | Zhou et al. |
| D776,315 | S | 1/2017 | Wu |
| 9,599,312 | B2 | 3/2017 | Chen |
| D783,872 | S | 4/2017 | Aksnes |
| D787,104 | S | 5/2017 | Wu |
| D824,077 | S | 7/2018 | Davis et al. |
| 10,041,660 | B2 | 8/2018 | Harvey |
| 10,281,125 | B2 | 5/2019 | Harvey |
| 10,422,512 | B2 | 9/2019 | Seward et al. |
| D861,956 | S | 10/2019 | Preutz |
| D921,249 | S | 6/2021 | Peng |
| 2006/0204328 | A1 | 9/2006 | Frey |
| 2007/0041209 | A1 | 2/2007 | Glass |
| 2007/0139921 | A1 | 6/2007 | Wu |
| 2007/0246631 | A1 | 10/2007 | Brown et al. |
| 2007/0278376 | A1 | 12/2007 | Townsend, Jr. |
| 2008/0218992 | A1 | 9/2008 | Li |
| 2009/0290364 | A1 | 11/2009 | Thomas et al. |
| 2010/0053942 | A1 | 3/2010 | Tarter et al. |
| 2011/0116254 | A1* | 5/2011 | Workman ..... F21V 21/008 362/96 |
| 2011/0317418 | A1 | 12/2011 | Burrell, IV |
| 2012/0026727 | A1 | 2/2012 | Hajee et al. |
| 2012/0287611 | A1 | 11/2012 | Wilson et al. |
| 2013/0087672 | A1 | 4/2013 | Townsend, Jr. |
| 2013/0279180 | A1 | 10/2013 | Pearson et al. |
| 2014/0071681 | A1 | 3/2014 | Ghafoori et al. |
| 2014/0126187 | A1 | 5/2014 | Bennet et al. |
| 2014/0268707 | A1* | 9/2014 | Kim ..... F21L 4/00 362/186 |
| 2015/0040814 | A1 | 2/2015 | Volkwein |
| 2015/0198317 | A1 | 7/2015 | Feller et al. |
| 2015/0285449 | A1 | 10/2015 | Hajee et al. |
| 2016/0195235 | A1* | 7/2016 | Workman ..... F21V 1/08 362/280 |
| 2019/0113212 | A1 | 4/2019 | Dorman et al. |
| 2019/0178472 | A1 | 6/2019 | Young et al. |
| 2019/0219254 | A1 | 7/2019 | Harvey |

OTHER PUBLICATIONS

Garvin Industries, "LED Temporary Job Site Light", Accessed: Mar. 9, 2016, <http://www.garvinindustries.com/lighting/led-temp-lights>.

ProBuilt Lighting, "Hang-A-Light LED", Accessed: Mar. 9, 2016, <http://probuiltlighting.com/products/hang-a-light-led/>.

ProBuilt Lighting, "Hang-A-Light 200 Watt LED", Accessed: Mar. 9, 2016, <http://probuiltlighting.com/hal-200-watt-led/>.

United States Patent Office Action for U.S. Appl. No. 29/628,064 dated Oct. 18, 2019 (8 pages).

* cited by examiner

HANGING LIGHT

CROSS-REFERENCE TO RELATED APPLICATIONS

This application claims priority to U.S. Provisional Patent Application No. 62/749,181 filed on Oct. 23, 2018, the entire contents of which are incorporated herein by reference.

FIELD OF INVENTION

The present invention relates to portable lighting devices and, more particularly, to hanging lights.

SUMMARY OF INVENTION

The present invention may provide, in one independent aspect, a portable lighting device including a body having an interior cavity, a lighting unit supported by the body including a light emitting diode, and a terminal block supported within the interior cavity of the body. The terminal block configured to connect to a power source and provide electrical energy to the lighting unit to illuminate the light emitting diode. The portable lighting device also includes a port formed in the body in communication with the interior cavity. The port configured to allow an electrical wire to pass into the interior cavity to couple the electrical wire to the terminal block. The portable lighting unit further includes a wire clamp supported by the body at the port. The wire clamp includes a single actuator and a clamp. The single actuator is selectively movable relative to the body to move the clamp into engagement with the electrical wire passing through the port.

The present invention may provide, in another independent aspect, a portable lighting device including a body having a base with an interior cavity and a cover movably coupled to the base to selectively provide access to the interior cavity. The portable lighting device also includes a lighting unit supported by the body having a light emitting diode and a terminal block supported within the interior cavity of the body. The terminal block configured to connect to a power source and provide electrical energy to the lighting unit to illuminate the light emitting diode. The portable lighting device further includes a cover locking mechanism supported by the body that engages the base to maintain the cover in a closed configuration. The cover locking mechanism includes an actuator to selectively allow the cover to move to an open configuration. The actuator accessible by inserting a tool through a hole in the cover.

The present invention may provide, in yet another independent aspect, a portable lighting device including a body, a lighting unit supported by the body having a light emitting diode, and a hanging cable configured to hang the body from a support structure. The hanging cable includes a first end secured to the body and a second end portion opposite the first end. The portable lighting device also includes a cable clamp mechanism supported by the body. The cable clamp mechanism engages the second end portion of the hanging cable to secure the hanging cable relative to the body. The hanging cable includes a manual actuator to disengage the cable clamp mechanism to allow adjustment of a length of the hanging cable between the first end and the cable clamp mechanism.

Other independent features and independent aspects of the invention may become apparent by consideration of the following detailed description and accompanying drawings.

DETAILED DESCRIPTION

Figure 1:
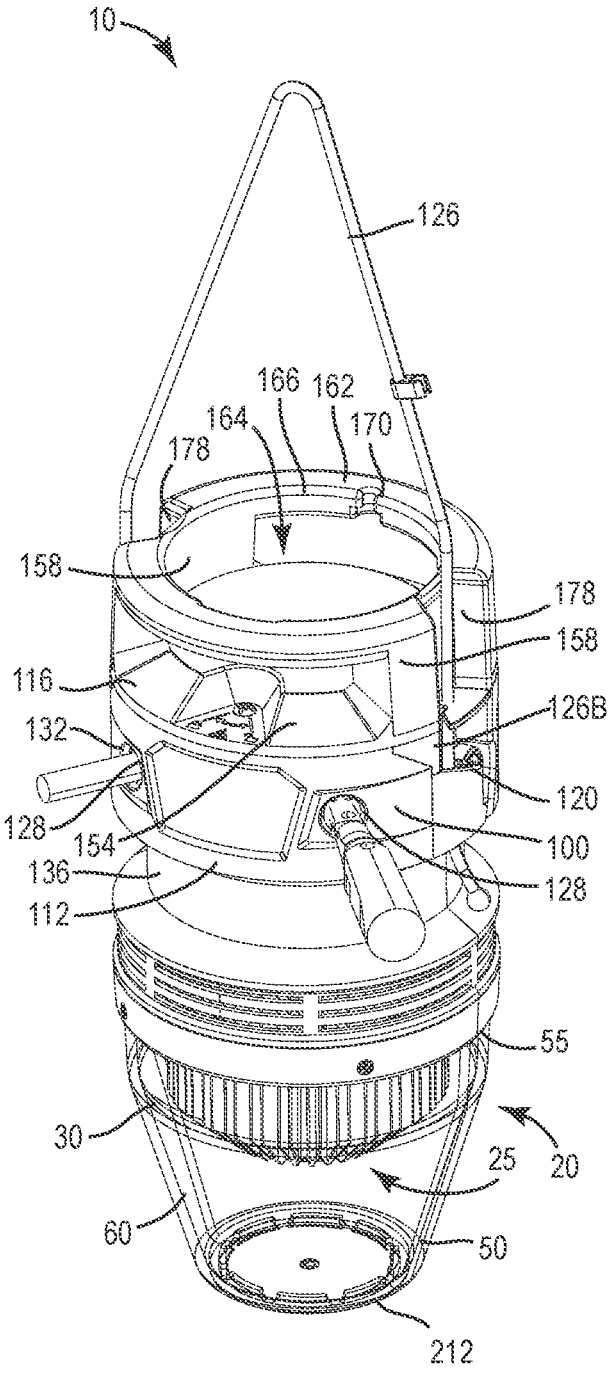
FIG. 1 is a perspective view of a portable lighting device.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting.

FIGS. 1-8 illustrate a portable lighting device 10, such as, for example, a high bay light or work light used at construction sites. The illustrated lighting device 10 includes a lighting unit 20, a lens 50, and a body 100. The lighting device 10 is designed to be portable and optionally includes features to allow a user to hang the lighting device 10 from another object, such as an overhead beam, rafter, pipe, etc.

The lighting unit 20 is supported by the body 100. As shown in FIGS. 1-4, the lighting unit 20 extends downwardly from the body 100 in an axial direction. In the illustrated embodiment, the lighting unit 20 includes a heat sink 30 with an interior cavity 35 (FIG. 4) that houses a plurality of light emitting diodes (LEDs) 25, which may optionally be disposed along a plurality of LED strips. The LEDs 25 are positioned in the cavity near the bottom, if viewed from the hanging orientation, of the heat sink 30. In other embodiments, the LEDs 25 of the lighting unit may be arranged in other configurations, or the lighting unit 20 may include a single LED. In further embodiments, the LEDs 25 may be chip on board (COB) LEDs that include more diodes.

Figure 2:
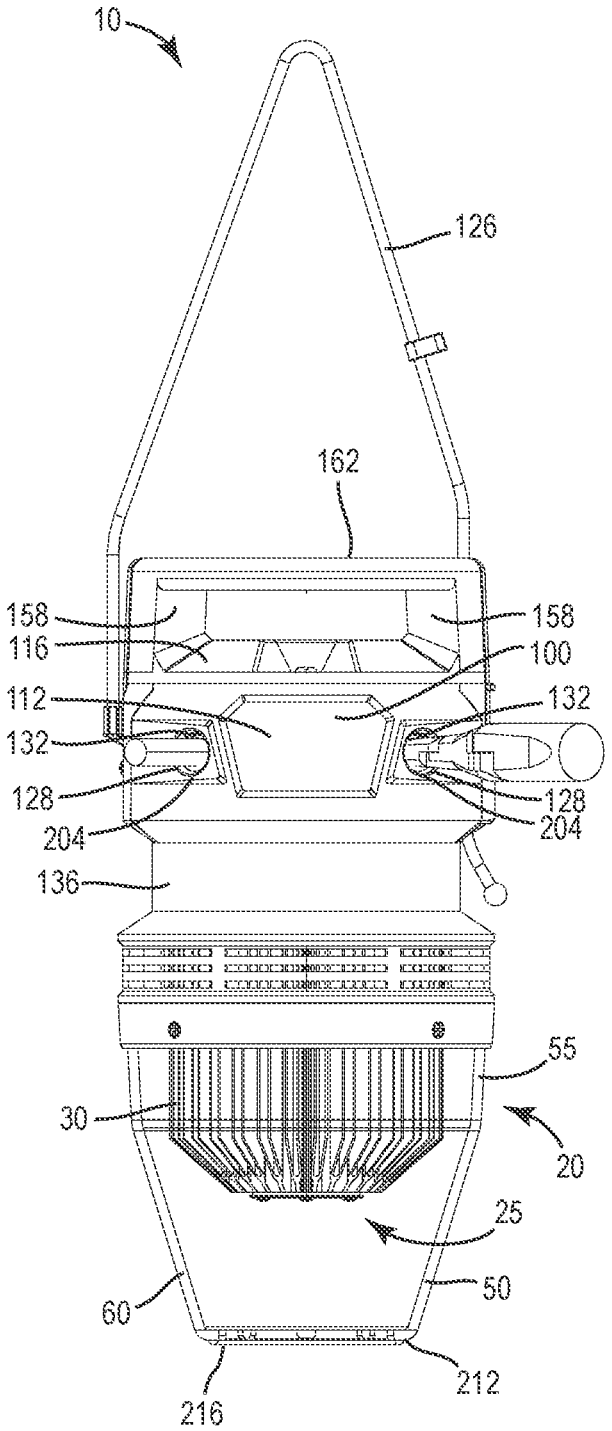
FIG. 2 is a side view of the portable lighting device of FIG. 1.
Figure 3:
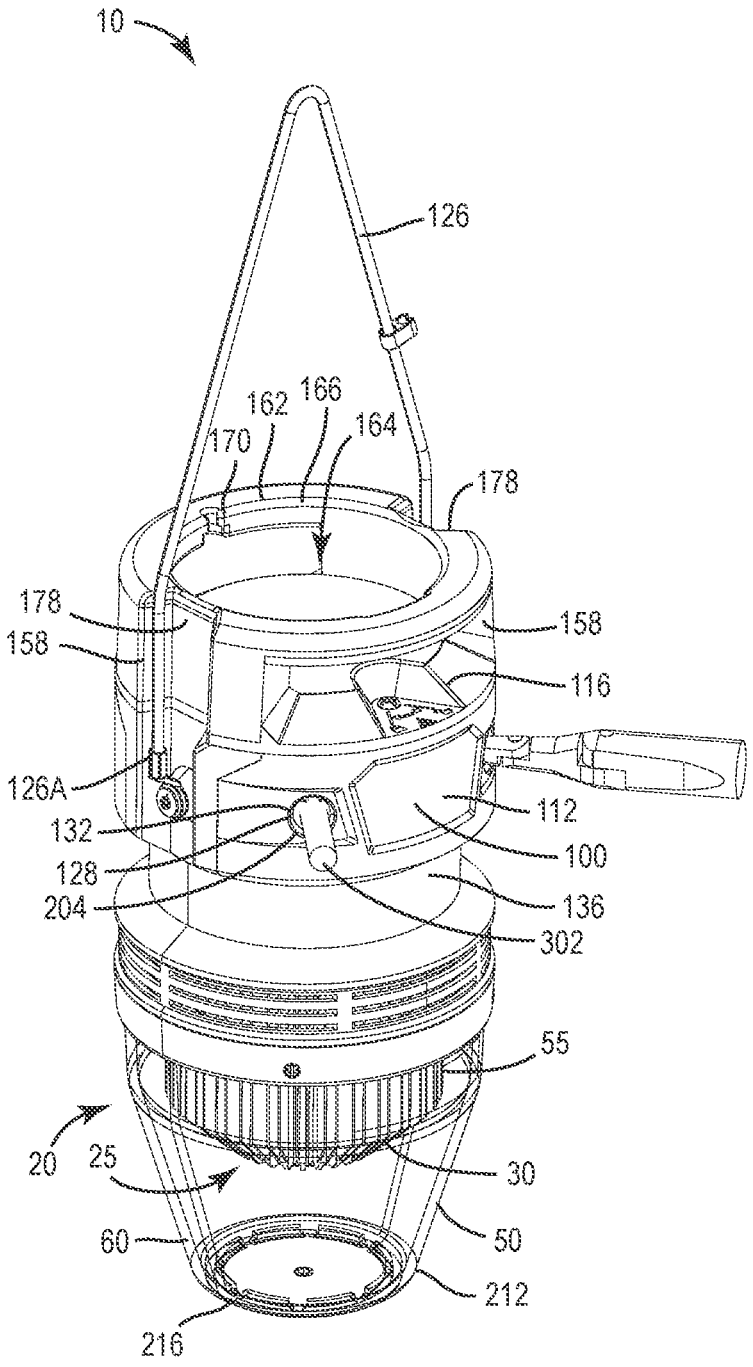
FIG. 3 is another perspective view of the portable lighting device of FIG. 1.
Figure 4:
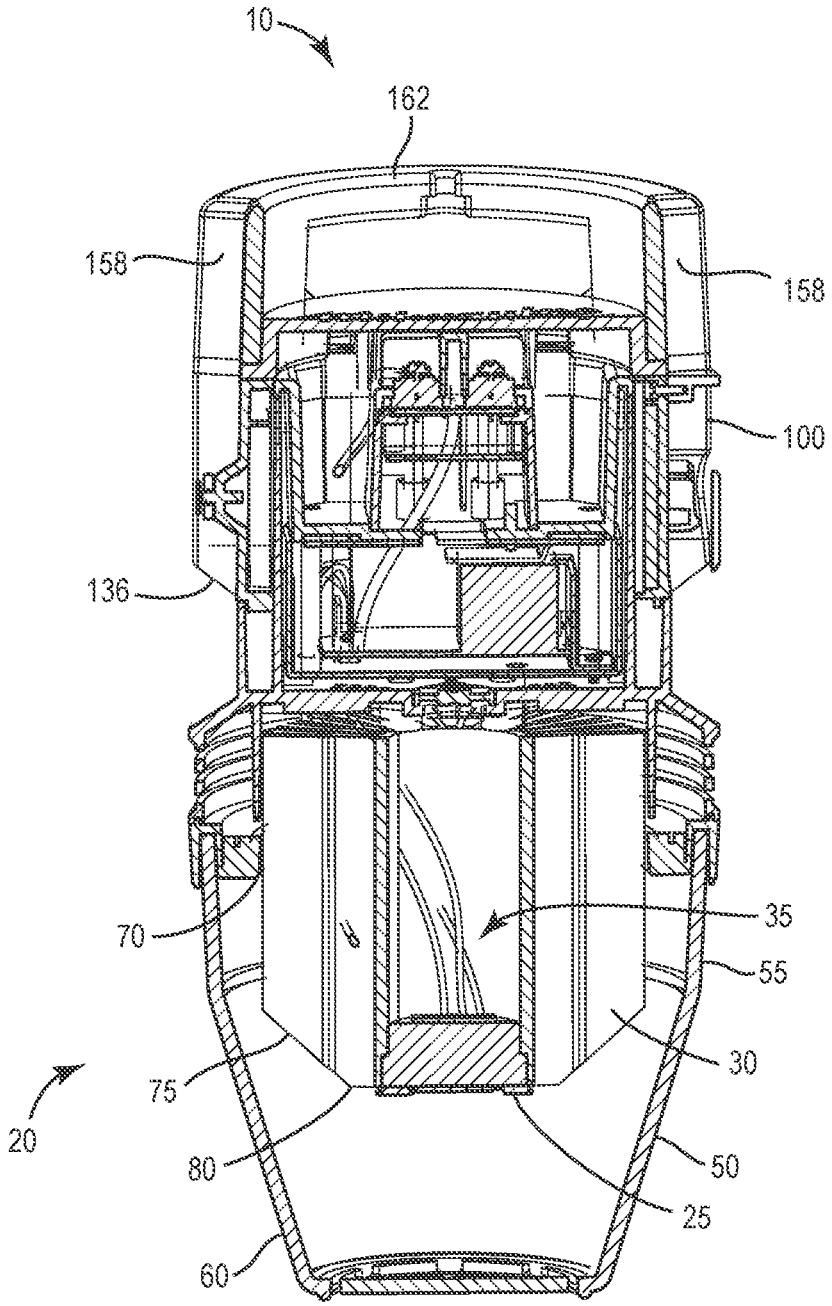
FIG. 4 is a cross sectional view of the portable lighting device of FIG. 1

With continued reference to FIGS. 1-3, the lens 50 is coupled to the body 100 and surrounds the lighting unit 20. In the illustrated embodiment, the lens 50 and the body 100 completely enclose the lighting unit 20. In other embodiments, the lens 50 may include gaps or apertures such that the lighting unit 20 is not completely enclosed. The lens 50 contains and protects the lighting unit 20, while also acting to diffuse light emitted by the lighting unit 20. In some embodiments, the lens 50 is constructed from a plastic, such as high density polyethylene (HDPE). In other embodiments, the lens 50 may be constructed from other materials (e.g., different plastics, glass, etc.).

The illustrated lens 50 is also detachably coupled to the body 100, allowing the lens 50 to be easily cleaned and/or replaced. In some embodiments, the lens 50 may be threadably coupled to the body 100. In other embodiments, the lens 50 may be detachably coupled to the body 100 in other suitable manners (e.g., press fitting, detents, bayonet couplings, etc.).

In the illustrated embodiment, the lens 50 is frustoconically-shaped and includes a top portion 55, a middle portion 60, and a flat bottom 212. The top portion 55 completely surrounds the heat sink 30 and is coupled to the body 100. The middle portion 60 of the lens 50 tapers from the top portion 55 to the flat bottom 212. In other words, the cross-sectional diameter of the middle portion 60 of the lens 50 decreases as it extends away from the body 100. The heat sink 30 is also frustoconically shaped, and includes a body portion 70, a cone portion 75 and a bottom 80.

Figure 5:
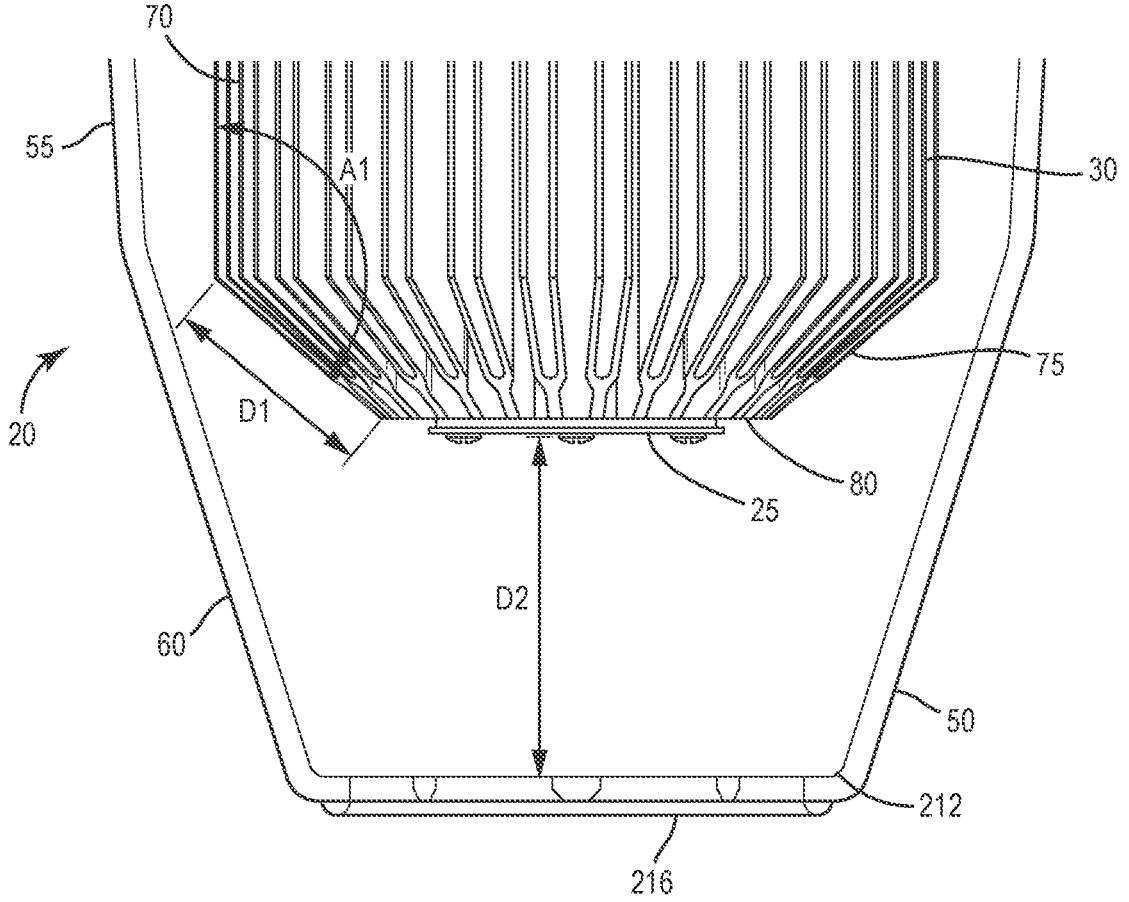
FIG. 5 is a side view of the portable lighting device of FIG. 1 detailing a frustoconical lens.

With reference to FIG. 5, in the illustrated embodiment, the cone portion 75 and the body portion 70 of the heat sink 30 define an angle of approximately 130 degrees. In other words, the cone portion 75 extends inwardly at an angle of about 60 degrees from the vertical. In other embodiments (not shown), the cone portion 75 and the body portion 70 may define an angle within the range of about 95 degrees to about 175 degrees.

In the illustrated embodiment, the length of the cone portion 75 could be 1.42 inches, and the distance between the bottom portion 80 of the heat sink 30 and the flat bottom 212 of the lens 50 could be 2.23 inches. As illustrated, the ratio of the length of the cone portion 75 to the distance between the bottom portion 80 of the heat sink 30 and the flat bottom 212 of the lens 50 is about 1:1.57. In other embodiments (not shown), the ratio of the length of the cone portion 75 to the distance between the bottom portion 80 of the heat sink 30 and the bottom 212 of the lens 50 could be lower or higher, as described below.

Figure 6:
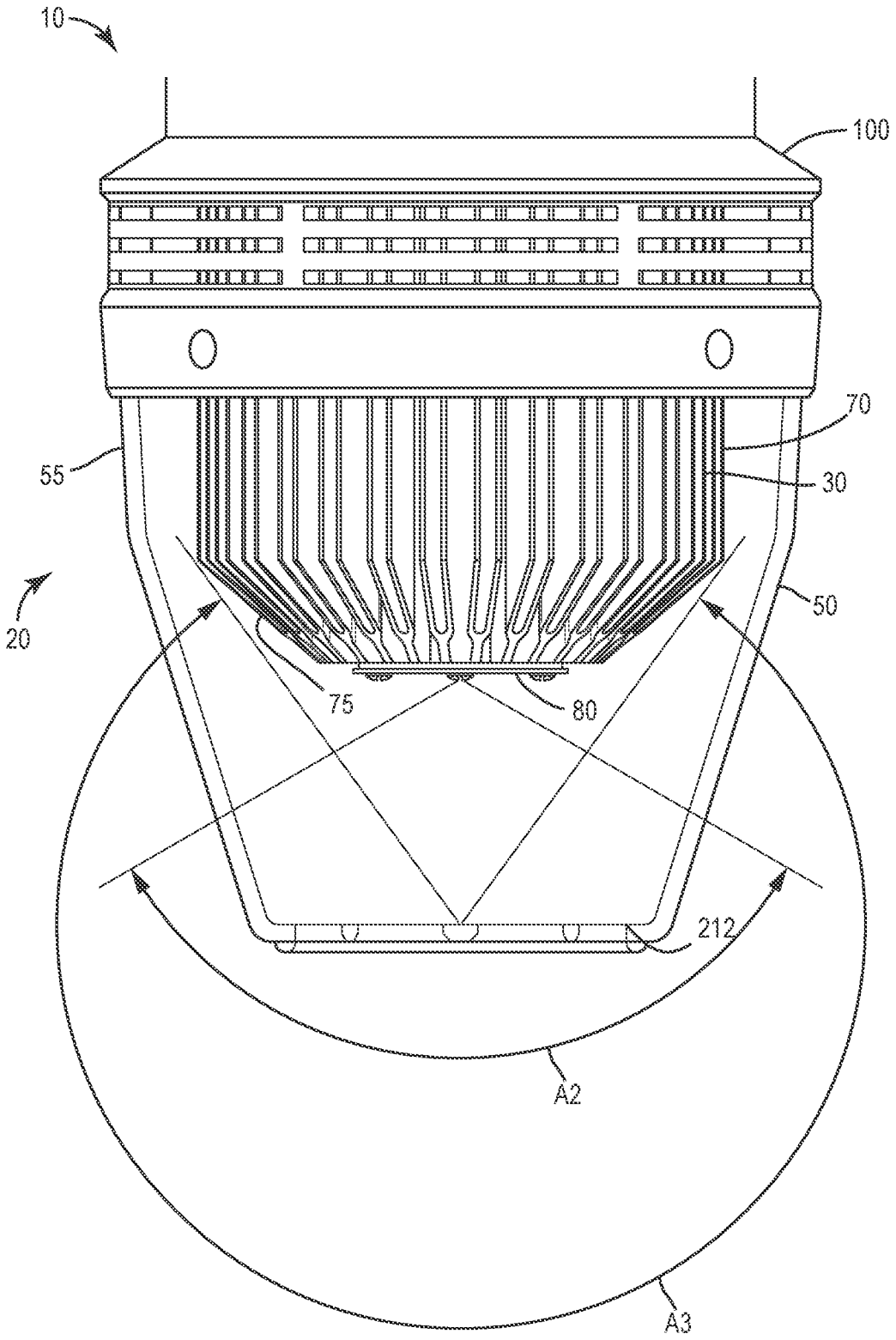
FIG. 6 is a second side view of a lighting unit on the portable lighting device of FIG. 1.

With reference to FIG. 6, in the illustrated embodiment, light extends vertically from the cone of the LEDs 25 at an angle of approximately thirty degrees from the horizontal. In other words, the cone of the LEDs 25 emits light vertically from the lens 50 within a range of 120 degrees. Additionally, a single LED may have a degree dispersion angle within a range of 120 degrees. The illustrated frustoconical shape of the lens 50 allows for light rays to extend vertically from the LEDs 25 and reflect back vertically out the lens 50.

With continued reference to FIG. 6, with the frustoconical-shaped heat sink 30, light produced by the LEDs 25 may reflect off the frustoconical lens 50 and pass the heat sink 30 in a vertical direction and, thus, illuminate areas above the LEDs 25 and above the portable lighting device 10. In the illustrated construction, light produced from the LEDs illuminates an area of approximately 287 degrees from the center of the bottom 212. In contrast, with a cylindrical heat sink, the heat sink would block light that passes the cone portion 75 to reduce the area of illumination.

In other embodiments (not shown), the area of illumination can be increased by increasing the distance between the LEDs 25 and the bottom 212 of the lens 50 and/or by decreasing the size of the heat sink 30 (e.g., the diameter of the body portion 70). In such embodiments, the area of illumination may only be maximized to cover to the outer edge of the body 100.

Figure 8:
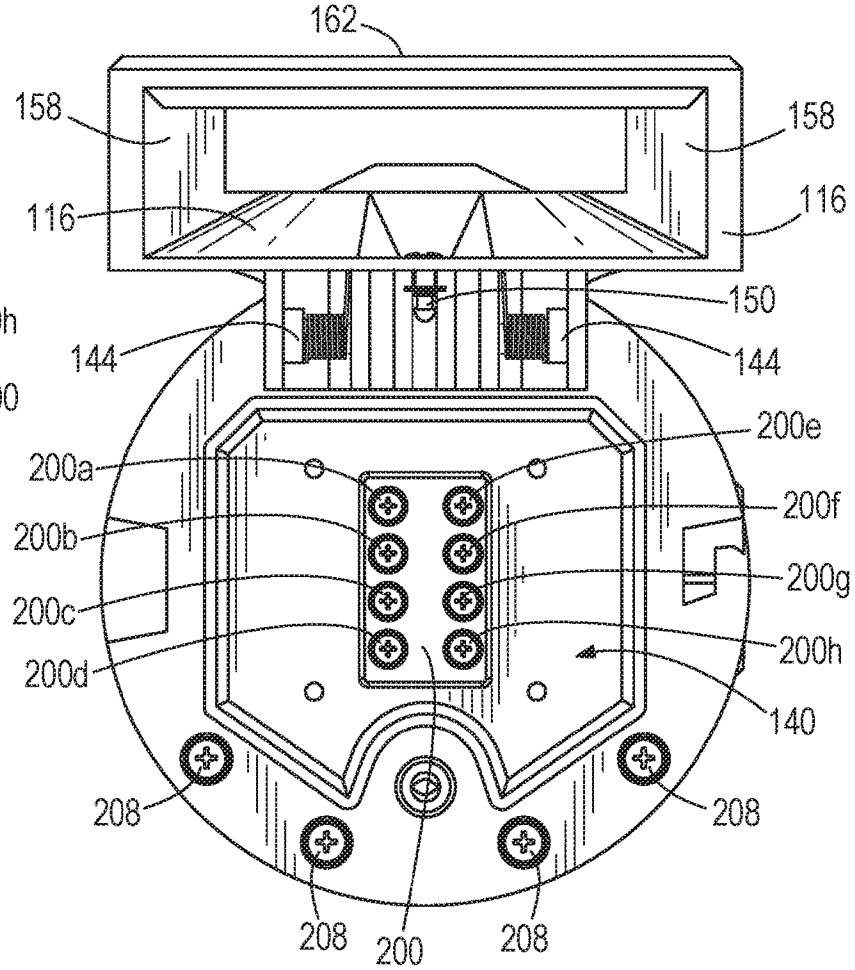
FIG. 8 is a top view of the body of the portable lighting device of FIG. 6 with the cover in the open position.
Figure 7:
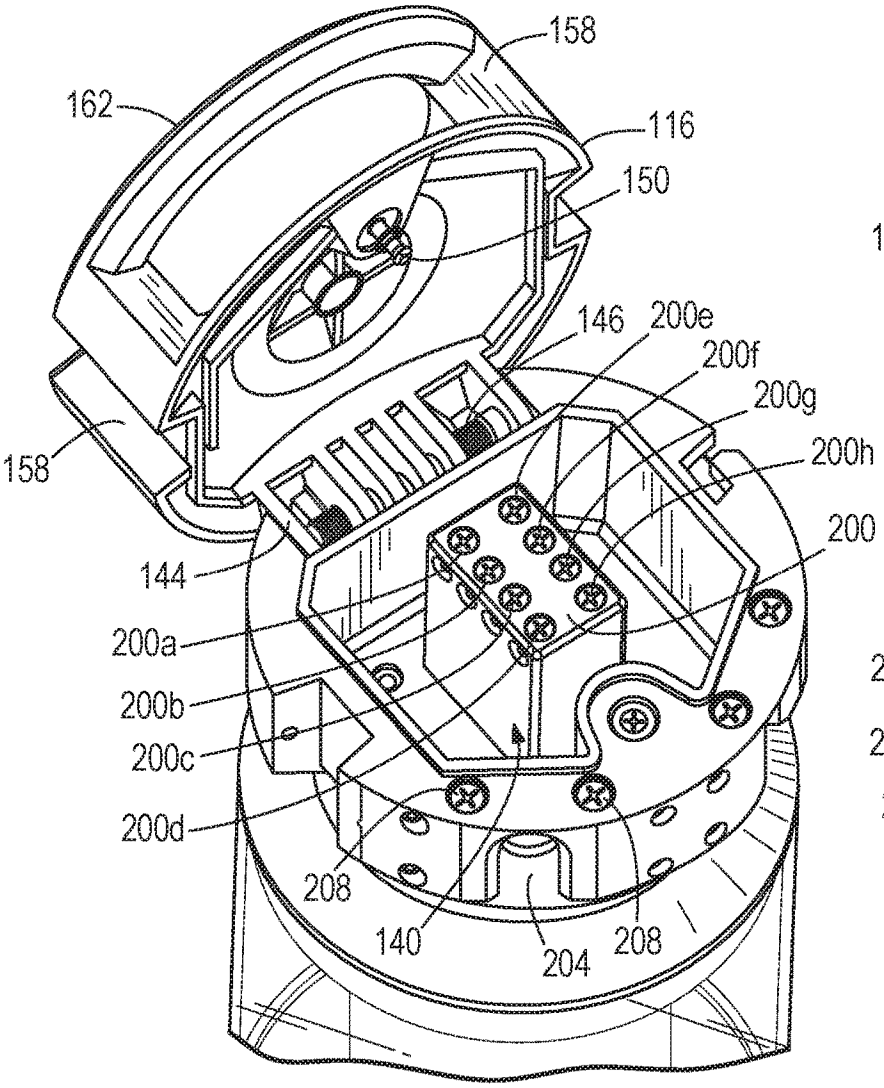
FIG. 7 is a top perspective view of a body of the portable lighting device of FIG. 1 with a cover in an open position.

The illustrated body 100 is generally cylindrically-shaped and includes a base 112, a cover 116, and an annular rim 162. The base 112 is coupled to the lens 50. The base 112 includes a reduced diameter portion 136, or neck, between the cover 116 and the lens 50. The reduced diameter portion 136 allows an excess length of hanging cable or electrical wire to be wrapped and stored around the body 100. As shown in FIGS. 7 and 8, the base 112 also has an interior cavity 140 that receives a terminal block 200. Two ports 128 (FIG. 2) are formed in the base 112 in communication with the interior cavity 140. As further described below, the ports 128 allow electrical wires to pass into the interior cavity 140 to couple to the terminal block 200.

Figure 9:
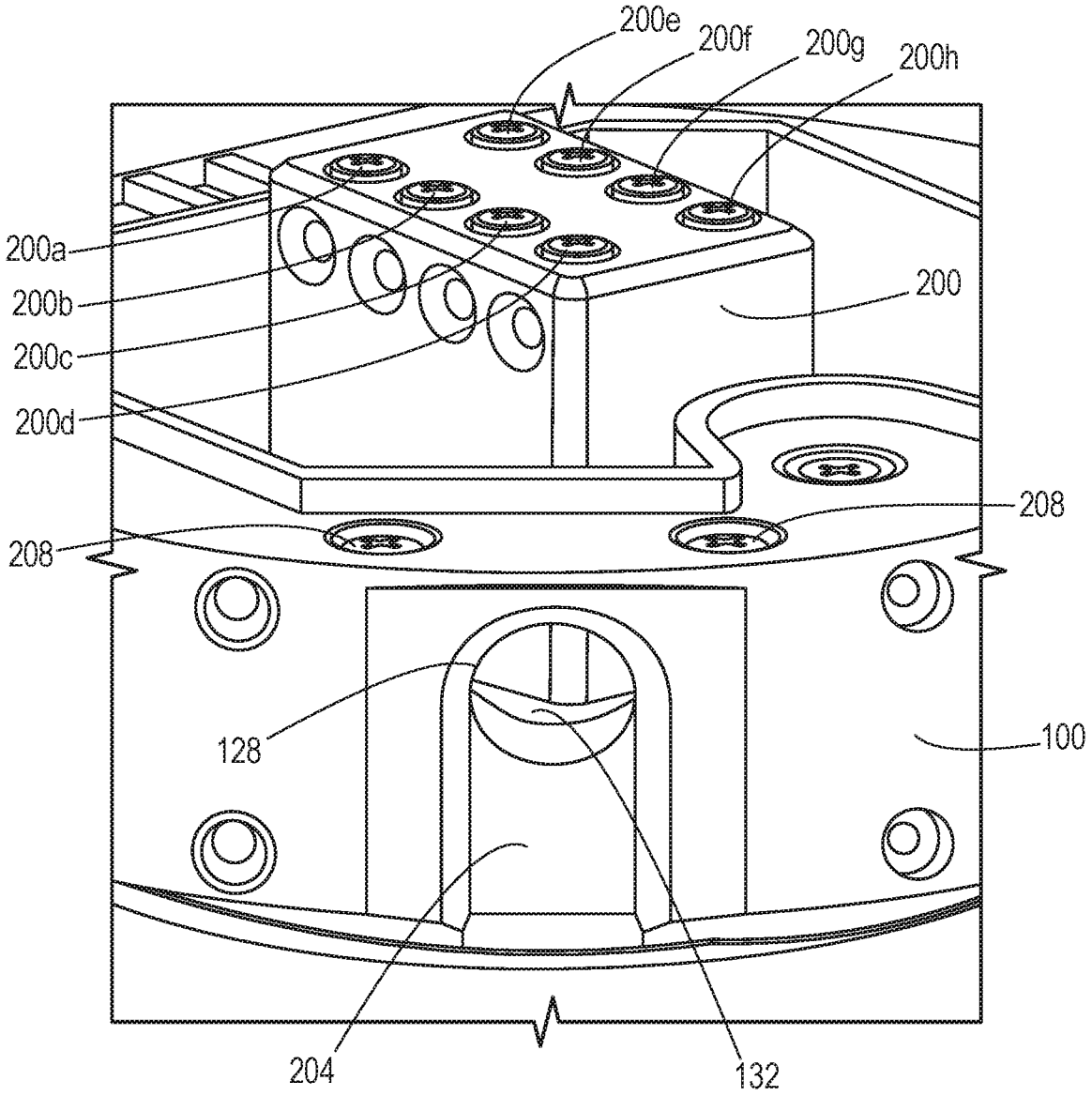
FIG. 9 is an enlarged perspective view of a terminal block of the portable lighting device.

The cover 116 is movably coupled to the base 112 for movement between a closed configuration (FIGS. 1-3) and an open configuration (FIGS. 7-9). The cover 116 encloses the interior cavity 140 of the base 112 when in the closed configuration. As shown in FIGS. 7 and 8, the cover 116 is pivotally coupled to the base 112 by a hinge 144. The hinge 144 allows the cover 116 to pivot to the open configuration.

In some embodiments, such as the illustrated embodiment, the cover 116 is biased to the open configuration by one or more springs 146 (e.g., torsion springs).

The cover 116 also includes a locking mechanism 150 to maintain the cover 116 in the closed configuration against the bias of the spring(s) 146. In the illustrated embodiment, the locking mechanism 150 includes a quarter-turn fastener that may be rotated by a user with, for example, a screw driver to unsecure the locking mechanism 150 from the base 112. In other embodiments, other types of detachable coupling mechanisms (e.g., push button latches, ball detents, etc.) that may or may not require tools to actuate may alternatively be used to hold the cover 116 in the closed configuration. In some embodiments, a gasket may be positioned between the cover 116 and the base 112 to seal the interior cavity 140 when the cover 116 is closed.

As shown in FIGS. 1-3, the annular rim 162 is supported by the cover 116 above the base 112. In the illustrated embodiment, two posts 158 extend upwardly from the cover 116 to support the rim 162. The annular rim 162 defines a generally circular opening 164 in the body 100. The rim 162 has a chamfered interior edge 166 that defines the opening 164. The rim 162 also includes a notch 170 formed in the interior edge 166. The notch 170 is configured to receive a fastener, such as a nail, to hang the lighting device 10 from a support structure, such as a wall. The annular rim 162 also includes two channels 178 formed in an outer surface of the rim 162. The channels 178 extend continuously through the posts 158 and an outer surface of the cover 116. As further explained below, the channels 178 are configured to receive portions of a hanging cable 126 to help guide the cable.

With continued reference to FIGS. 1-3, the illustrated lighting device 10 includes a hanging cable 126 coupled to the body 100. The hanging cable 126 is configured to hang the lighting device 10 from a support structure, such as an overhead beam, rafter, or pipe. The hanging cable 126 includes a first end 126A (FIG. 3) secured to the body 100 by a pin, rivets, a hook, etc. The hanging cable 126 also includes a second end portion 126B (FIG. 1) opposite from the first end 126A and adjustably coupled to a cable clamp mechanism 120 of the lighting device 10.

The cable clamp mechanism 120 is supported by the body 100 at a location diametrically opposite from where the first end 126A of the cable 126 is secured to the body 100. In particular, the cable clamp mechanism 120 is aligned with one of the channels 178, and the first end 126A of the cable 126 is secured in the other channel 178. This arrangement allows the hanging cable 126 to be extended over the cover 116 to form a loop for hanging the lighting device 10. The cable clamp mechanism 120 also allows the length of the cable 126 between the secured first end 126A and the cable clamp mechanism 120 to be adjusted (e.g., increased or decreased) by pulling the second end portion 126B of the cable 126 through or releasing the second end portion 126B of the cable 126 from the cable clamp mechanism 120. Adjusting the length of the cable 126 changes the size of the loop formed by the hanging cable 126. Excess length of the hanging cable 126 can be wrapped around the reduced diameter portion 136 of the base 112 for storage.

FIGS. 7-9 illustrate the cover 116 in an open configuration to expose the terminal block 200. The terminal block 200 includes a plurality of screw terminals for connecting electrical wires to the lighting device 10. In the illustrated embodiment, the terminal block 200 includes eight terminals 200*a-h* arranged as two sets of four terminals.

One set of terminals 200*a-c* acts as a power input, and includes a power in terminal 200*a*, a ground terminal 200*b*, and neutral terminal 200*c*. These terminals 200*a-c* are electrically coupled to an external power source via electrical wires and to the lighting unit 20 to power the LEDs 25. The other set of terminals 200*e-g* acts as a power output, and includes a power out terminal 200*e*, a ground terminal 200*f*, and a neutral terminal 200*g*. These terminals 200*e-g* allow a peripheral device, such as another portable lighting device, to be electrically coupled to and draw power from the lighting device 10. As such, multiple portable lighting devices 10 can be connected, or daisy-chained, together to form a string of lights that receive power from the same external power source.

The illustrated terminal block 200 also includes two pass-through screw terminals—an input terminal 200*d* and an output terminal 200*h*. The pass-through terminals 200*d*, 200*h* are configured to receive power from the external power source or a second external power source, and pass electricity through the terminal block 200. That is, electricity is passed directly through the lighting device 10 without being consumed or attenuated by the lighting device 10 (e.g., to power the lighting unit 20, etc.). Sufficient power can thereby be provided to downstream lights by the pass-through terminals 200*d*, 200*h* if, for example, many lights are strung together. Accordingly, one or more peripheral devices (including additional portable lighting units 10) may be connected to the lighting device 10 via either the output terminals 200*e-g* or the pass-through terminals 200*d*, 200*h*.

In one example, a plurality of lighting devices 10 may be electrically connected to a common power source via terminal blocks 200 disposed in each lighting device 10. If the first lighting device 10 is coupled to the external power source, and each subsequent lighting device 10 is coupled to the output terminals of an adjacent device 10, the number of lights that may be connected in series is limited by the power usage of each upstream device 10. In order to overcome this power consumption, the pass-through terminals 200*d*, 200*h* transfer power without significant usage or attenuation. Accordingly, a greater number of lighting devices 10 and/or other peripheral devices may be coupled in series.

Referring back to FIG. 2, the illustrated lighting device 10 includes two wire clamps 132 supported by the body 100 at the ports 128. The wire clamps 132 help secure the electrical wires to the lighting device 10, inhibiting the wires from being unintentionally pulled out of the terminal block 200. One of the ports 128 and clamps 132 are associated with the input terminals 200*a-d*, and the other port 128 and clamp 132 are associated with the output terminals 200*e-h*.

Each clamp 132 is associated with one of the ports 128 and includes a door 204 (FIG. 9). The doors 204 are movable (e.g., slidable) relative to the body 100 to open and close the ports 128. When the doors 204 are opened, the electrical wires may be inserted through or pulled out of the ports 128. When the doors 204 are closed, the doors 204 engage the electrical wires to hold the wires in place, thereby inhibiting disconnection of the wires from the terminal block 200.

Each wire clamp 132 also includes an adjustment member 208 coupled to the door 204. The adjustment member 208 is actuatable to move the door 204 relative to the body 100. As shown in FIGS. 7 and 8, the illustrated adjustment members 208 are screws that are operatively coupled to the doors 204. The screws 208 are rotatable to move the doors 204 up and down. In the illustrated embodiment, two screws 208 are associated with each door 204, and both screws 208 are rotated to move the door 204. In other embodiments, only one screw 208 may be used to move each door 204.

In further embodiments, other types of mechanisms may be used for moving the doors 204 relative to the body 100.

For example, the doors 204 may be spring-biased closed and manually moved open, the doors 204 may be associated with switches that change their positions, or the doors 204 may include detents to hold the doors open and closed with handles to manually move the doors 204.

As shown in FIGS. 1-3, the lower portion 212 of the lens 50 is a boss or projection having a similar shape and size as the opening 164 defined by the annular rim 162. In addition, the lower portion 212 has a chamfered exterior edge 216 corresponding to the chamfered interior edge 166 of the annular rim 162. In this way, the lower portion 212 of the lens 50 of a first lighting device 10 may be received and seated in the opening 164 of a second lighting device 10 so that multiple lighting devices 10 may be stacked upon one another. The chamfered edges 166, 216 help the lighting devices 10 seat snugly on top of each other.

In operation, the device 10 may be hung on or otherwise connected to an external structure via the hanging cable 126 or notch 170. The lighting device 10 is also electrically coupled to a power source, such as a DC power source (e.g., a battery pack) or an AC power source (e.g., a standard 120V power outlet) via one or more electrical wires, to power the LEDs 25 of the lighting unit 20. The light emitted by the LEDs 25 passes through the lens 50, which diffuses light to provide light to a larger area and to provide more uniform lighting. Furthermore, additional lighting devices, or other peripheral devices, may be coupled to the lighting device 10 via the power outlet or the pass-through terminals as described above.

Figure 10:
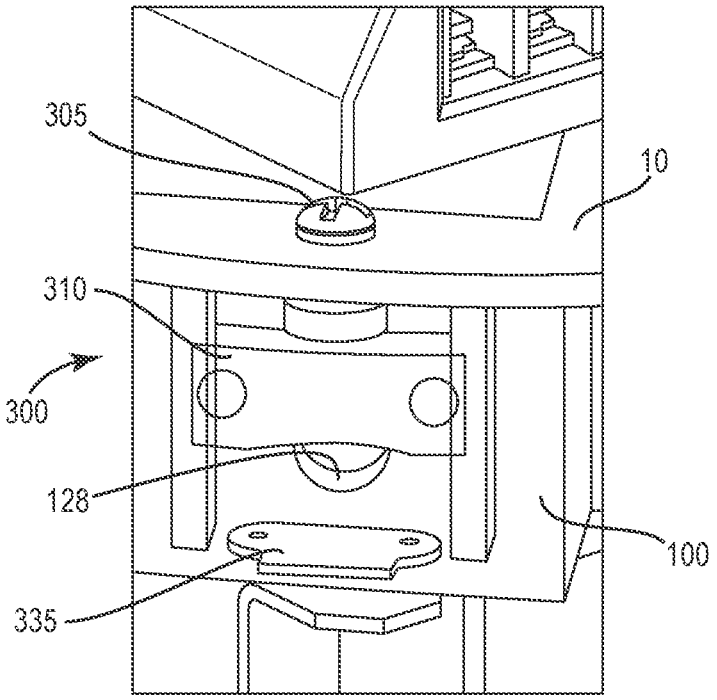
FIG. 10 is a perspective view of a wire retainer for use with a portable lighting device.
Figure 11:
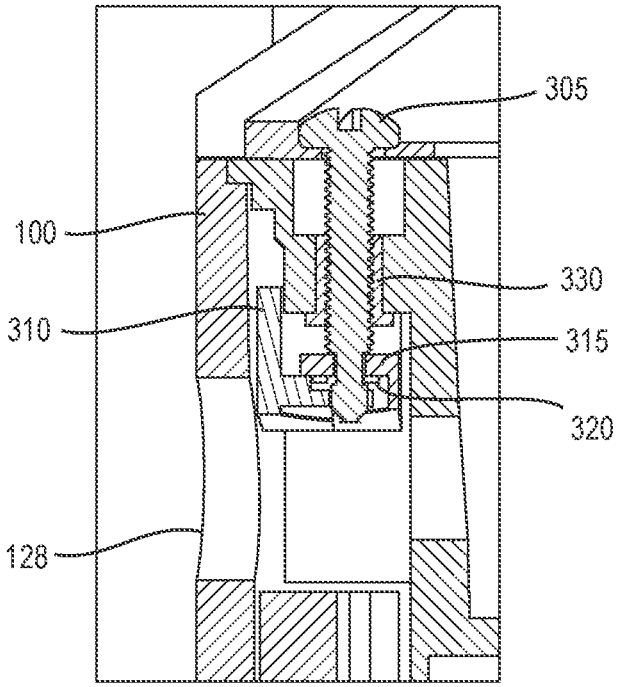
FIG. 11 is a partial cross-sectional view of the wire retainer of FIG. 10.

FIGS. 10 and 11 illustrate another wire clamp 300 for use on the device 10. The wire clamp 300 is similar to the wire clamp 132 with like features being represented by like reference numerals. The wire clamp 300 is positioned adjacent the ports 128 of the body 100 and clamps an AC or other wire 302 (FIG. 3) that is coupled to the terminal block 200 in the interior cavity 140. The wire clamp 300 includes a fastener 305, a front clamp 310, a back clamp 315, and an E-ring 320. The fastener 305 is threadably coupled to an insert 330 inside the body 100. The E-ring 320 secures the front clamp 310 to the back clamp 315.

As the fastener 305 is rotated in one direction (e.g., tightened), the fastener 305 moves the front and back clamps 310, 315 down towards a bottom plate 335 (FIG. 10) to secure the wire 302 in one of the ports 128. As the fastener 305 is rotated in an opposite direction (e.g., loosened), the fastener 305 moves the front and back clamps 310, 315 up away from the bottom plate 335 to release the wire 302. With such an arrangement, a single fastener is actuated to engage and disengage the wire clamp 300. In some embodiments, there may be a wire clamp 300 at both of the ports 128. In other embodiments, there may only be one wire clamp 300 at one of the ports 128.

Figure 12A:
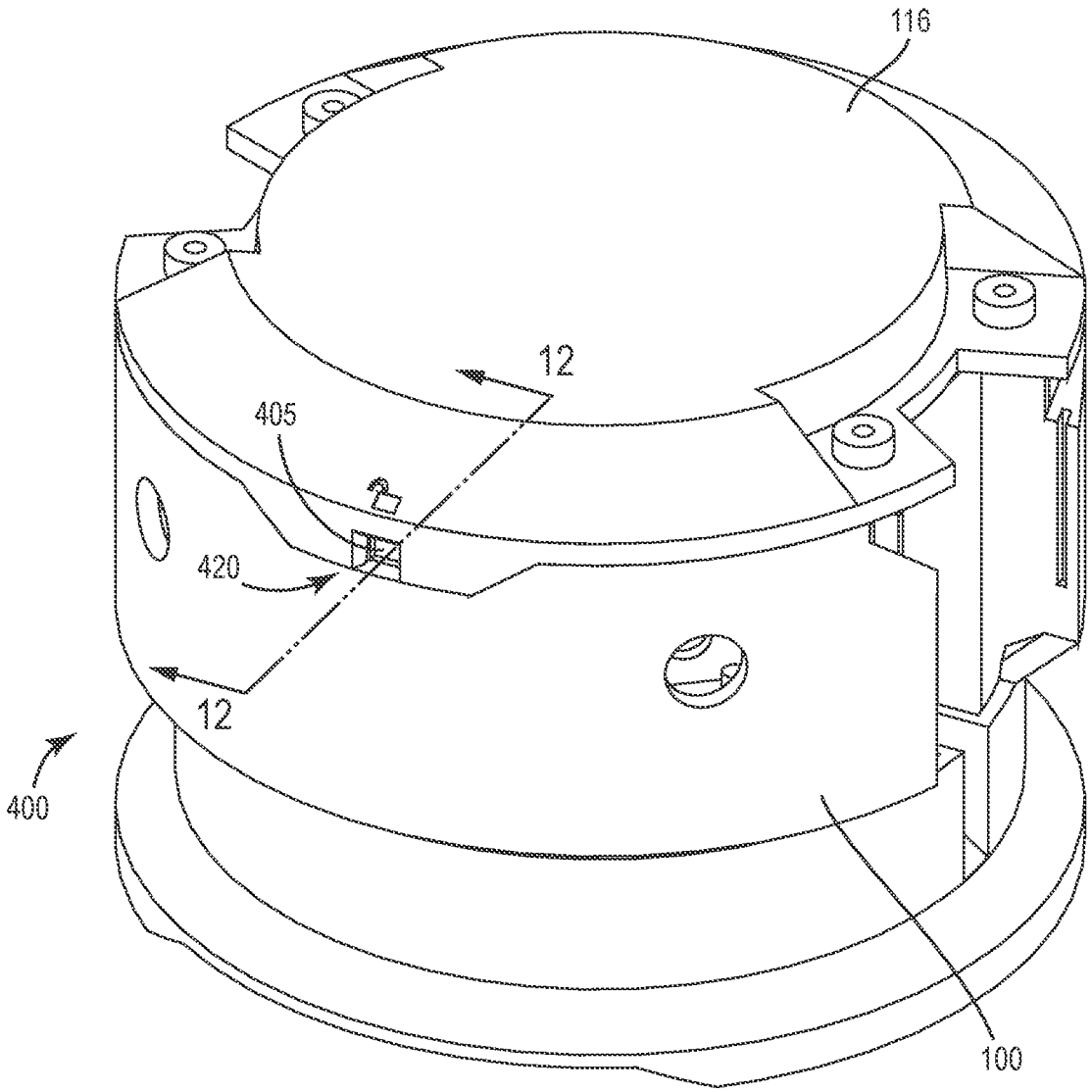
FIG. 12A is a perspective view of a cover locking mechanism for use with a portable lighting device.
Figure 12B:
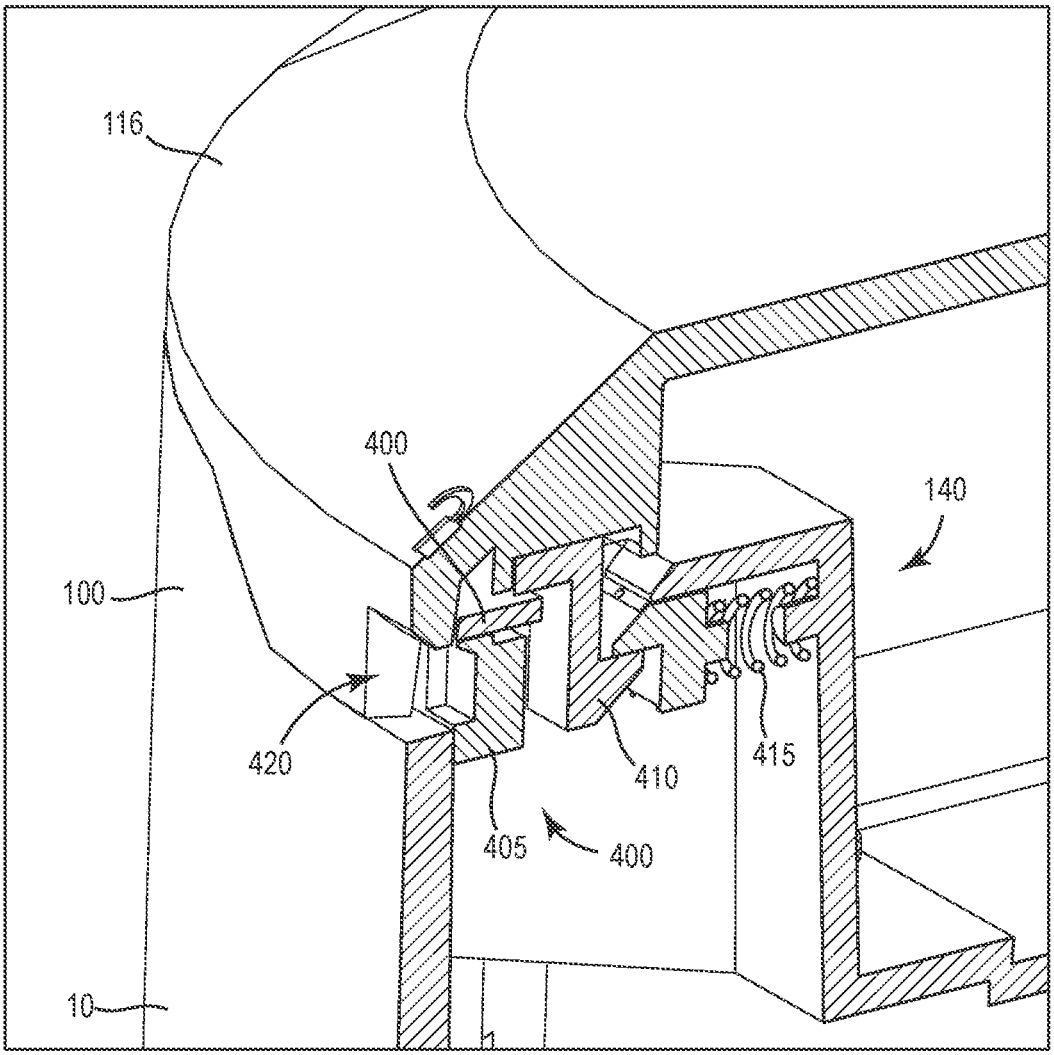
FIG. 12B is a cross-sectional view of the cover locking mechanism of FIG. 12A taken along lines 12-12.

FIGS. 12A and 12B illustrate a cover locking mechanism 400 for use on the device 10. The locking mechanism 400 is similar to the locking mechanism 150 with like features being represented with like reference numerals. The locking mechanism 400 maintains the cover 116 in the closed configuration and allows the cover 116 to move toward the open configuration to allow access to the interior cavity 140. The illustrated locking mechanism 400 includes a trigger 405, a latch 410, and a resilient member 415. The resilient member 415 biases the latch 410 into engagement with a flange 418 on the cover 116 to hold the cover 116 against the body 100 of the device 10. In some embodiments, the resilient member 415 may be, for example, a coil spring, although it may be other types of resilient members.

The trigger 405, or actuator, is moveable towards the latch 410 to push the latch 410 away from cover 116, allowing the cover 116 to open. A hole 420 in the cover 116 allows access to the trigger 405. In some embodiments, a tool or other object may be inserted into the hole 420 to push the trigger 405 against the bias of the resilient member 415 to release the latch 410. That is, the trigger 405 pushes the latch 410 inwardly to move the latch 410 out of engagement with the flange 418 of the cover 116. The cover 116 may then be opened (e.g., manually and/or by the springs 146 (FIG. 7)). The locking mechanism 400 is contained within itself so that dust and dirt do not get into the interior cavity 140 of the device 10.

Figure 13A:
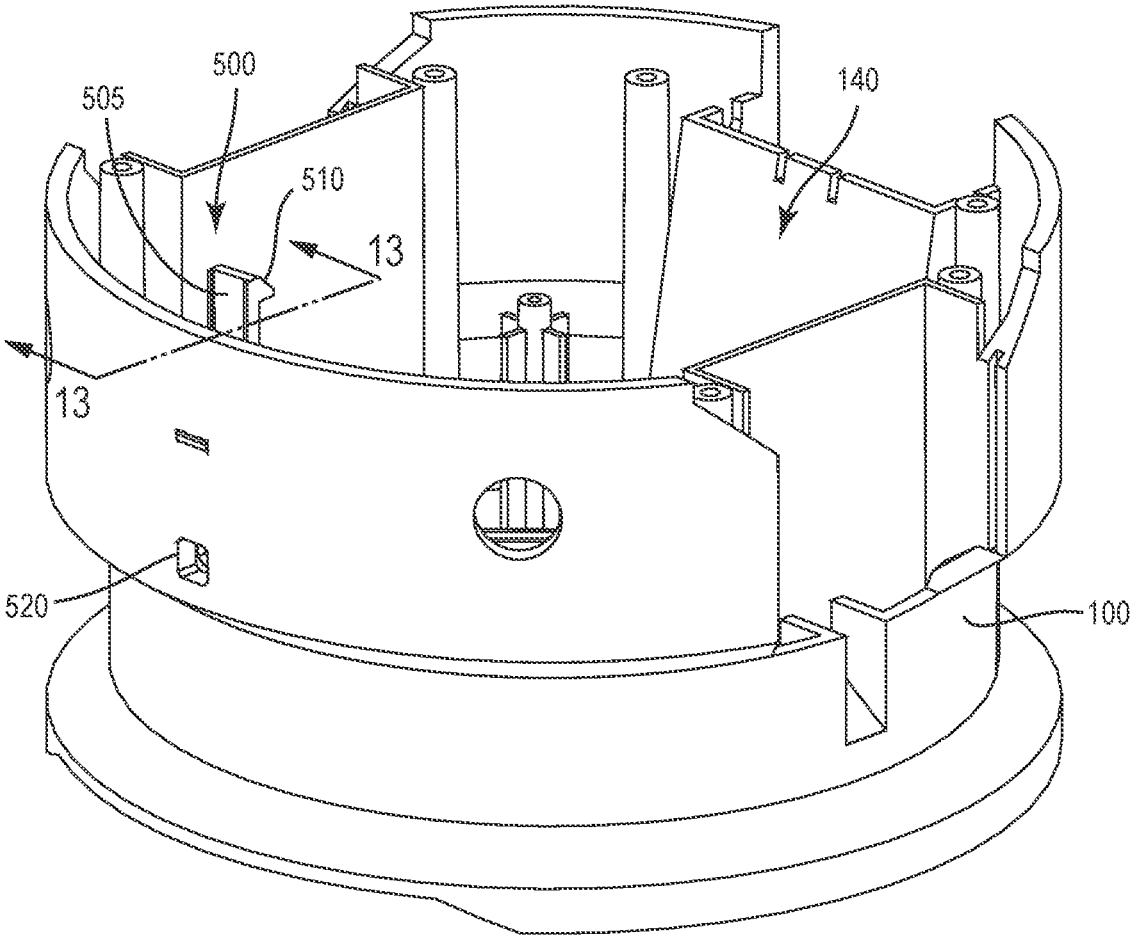
FIG. 13A is a perspective view of another cover locking mechanism for use with a portable lighting device without a lid.
Figure 13B:
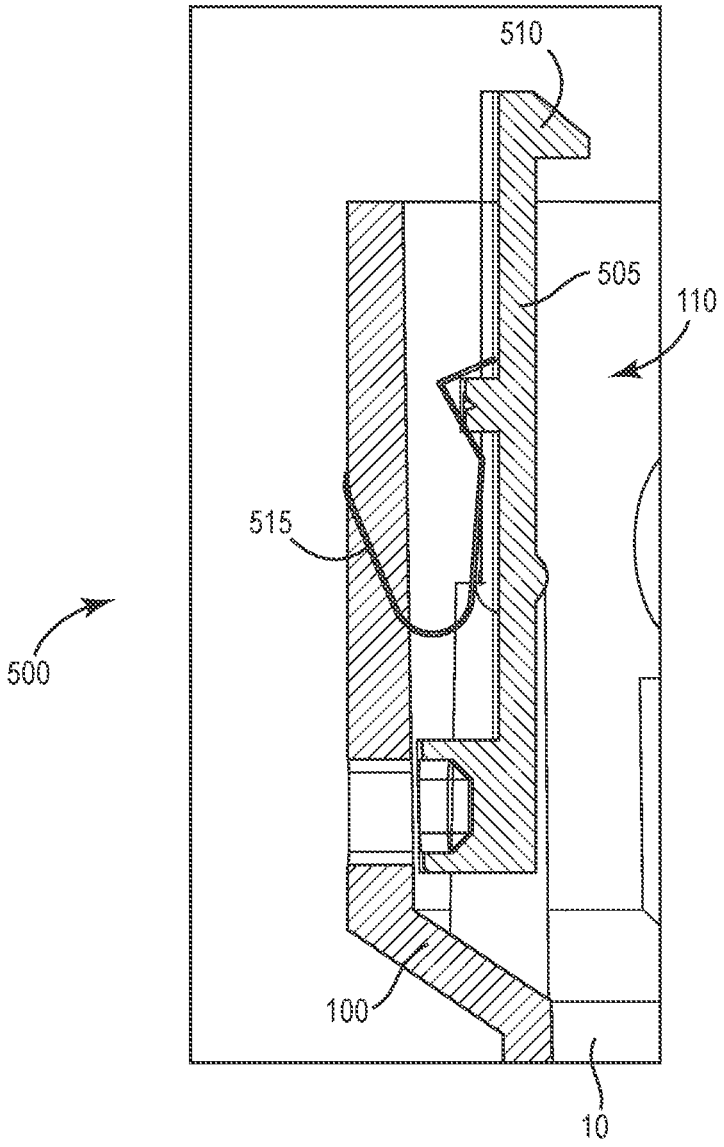
FIG. 13B is a cross-sectional view of the cover locking mechanism of FIG. 13A taken across lines 13-13.
Figure 14A:
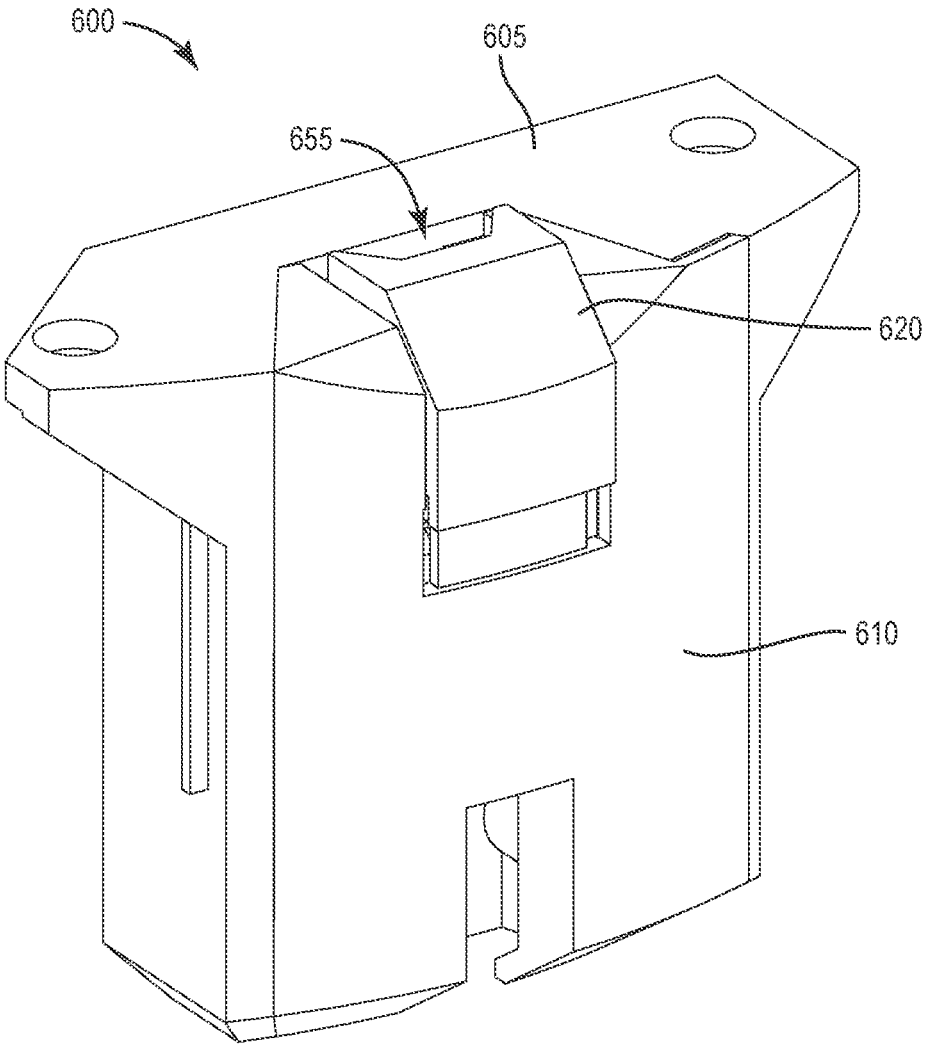
FIG. 14A is a perspective view of a cable clamp mechanism for use with a portable lighting device.
Figure 14B:
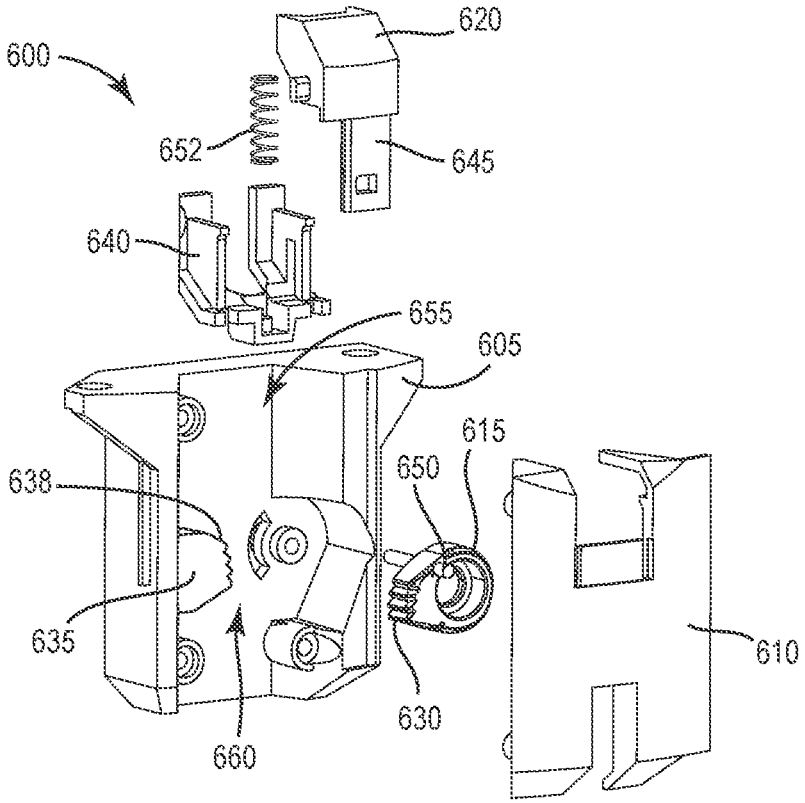
FIG. 14B is an exploded view of the cable clamp mechanism of FIG. 14A.

FIGS. 13A and 13B illustrate another locking mechanism 500 for use on the device 10. The locking mechanism 500 is similar to the locking mechanism 150 with like features being represented with like reference numbers. The locking mechanism 500 maintains the cover 116 in the closed configuration and allows the cover 116 to move toward the open configuration to allow access to the interior cavity 140. As shown in FIG. 13A, the locking mechanism is positioned in the interior 140 of the body 100 of the device 10. With reference to FIG. 13B, the locking mechanism 500 includes a latch 505 with a hook 510 at the upper end. The hook 510 engages a flange on the cover 116 to maintain the cover 166 in the closed configuration. A resilient member 515 that is coupled to the body 100 of the device 10 biases the latch 505 to secure the cover 116. In the illustrated embodiment, the resilient member 515 is a spring plate; although in other embodiments, the resilient member 515 may be other types of biasing members.

In some embodiments, a user may insert a tool into a hole 520 in the body 100 to move the latch 505, or actuator, against the bias of the resilient member 515. Moving the latch 505 disengages the hook 510 from the cover 116, releasing the cover 116. The cover 116 may then be opened (e.g., manually and/or by the springs 146 (FIG. 7)).

Figure 15:
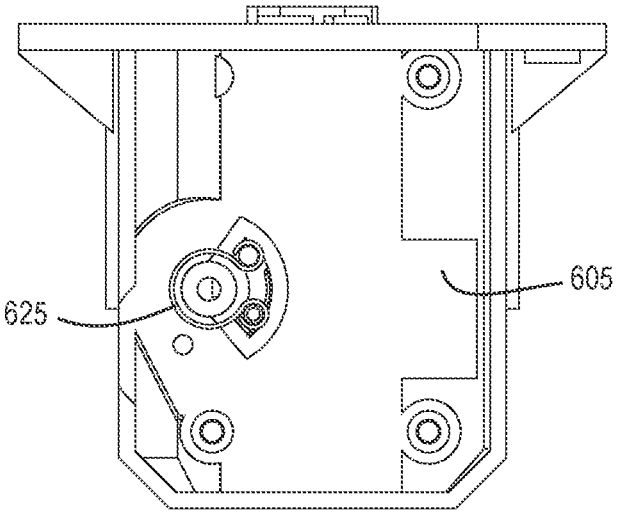
FIG. 15 is a rear view of the cable clamp mechanism of FIG. 14A.
Figure 16:
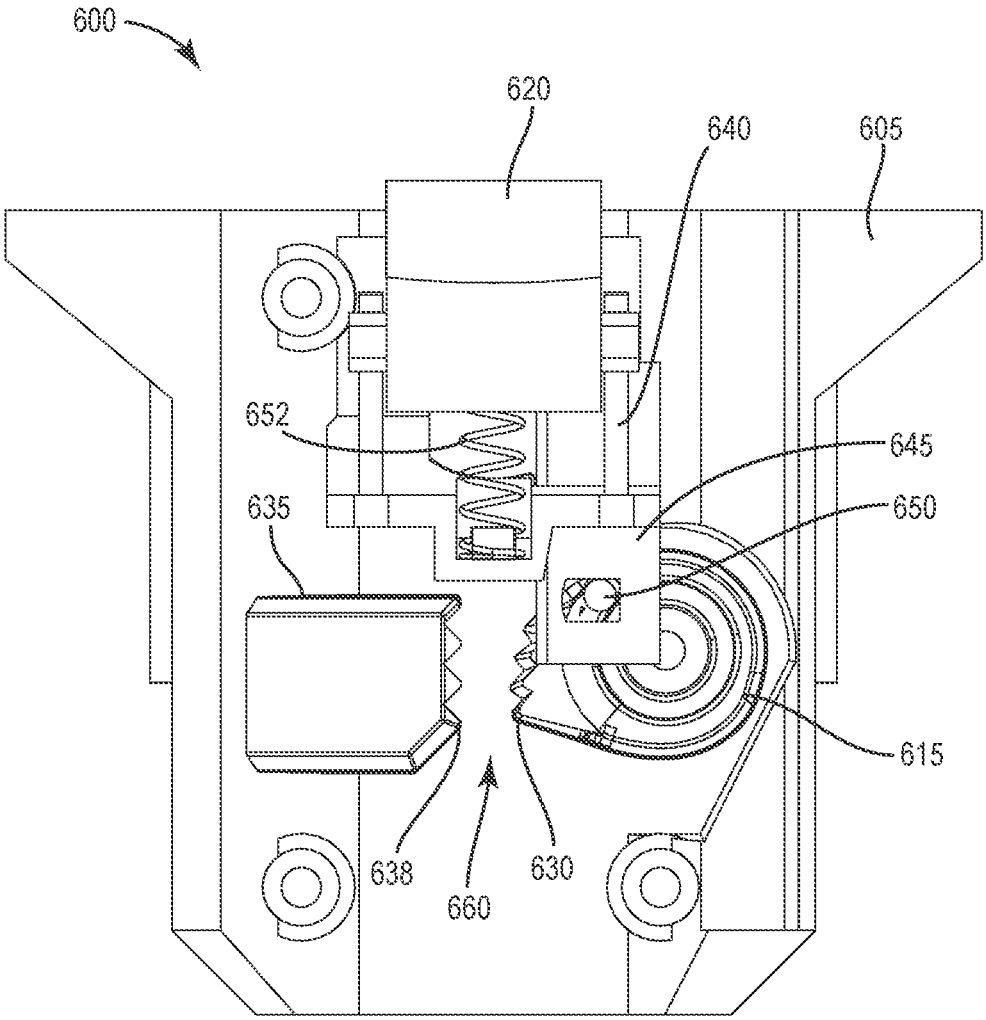
FIG. 16 is a front view of the cable clamp mechanism of FIG. 14A with a cover removed.

FIGS. 14A-14B, 15, and 16 illustrate a cable clamp mechanism 600 for use on the device 10. The cable clamp mechanism 600 is similar to the cable clamp mechanism 120 with like features being represented with like reference numerals. The cable clamp mechanism 600 is positioned at a similar location as the cable clamp mechanism 120 and selectively secures the second end 126B of the cable 126. The illustrated cable clamp mechanism 600 includes a housing 605, a cover 610, a cam 615, a button 620, and a resilient member 625 (FIG. 15). The housing 605 is coupled to the body 100 of the device 10. In other embodiments, the housing 605 may be integral with the body 100. The cam 615 is rotatably coupled to the housing 605 and includes a toothed cam surface 630 that is configured to engage the cable 126. The button 620, or actuator, is slidable within a track 640 that is coupled to the housing 605. The button 620 includes a latch 645 that couples to a pin 650 on the cam 615. A compression spring 652 biases the button 620 away from the track and out of the housing 605. The cover 610 is coupled to the housing 605 to at least partially cover the cam 615 and protect the cable clamp mechanism 600 therebetween. The cover 610 defines an opening 655 between an upper portion of the cover 610 and the housing 605. The opening 655 supports the button 620 and receives the second end 126B of the cable 126. Referencing FIG. 15, the resilient member 625 is coupled at a first end to the housing 605 and at a second end to the pin 650. The resilient member 625 biases the cam 615 towards a projection 635 having a toothed surface 638. In the illustrated embodiment, the resilient member 625 is a torsion spring, although in other embodiments, the resilient member 625 may be other types of springs.

In operation, the second end 126B of the cable 126 extends through the opening 655 and into the clamp mechanism 600 between the projection 635 on the housing 605 and the cam 615. The second end 126B of the cable 126 is then clamped between the toothed surface 638 of the projection 635 and the toothed surface 630 of the cam 615. The cam 615 inhibits the cable 126 from moving in one direction relative to the housing 605. For example, a user may tighten (e.g., shorten) the cable 126 by pulling the cable 126 further through the opening 655 (i.e., downward in the figures). Movement of the cable 126 in a downward direction temporarily rotates the cam 615 away from the projection 635 against the bias of the resilient member 625. However, the cam 615 inhibits the cable 126 from being pulled in the other direction to loosen (e.g., lengthen) the cable 126.

A user may lengthen the cable 126 by pressing the button 620 against the bias of the compression spring 652 so that the button 620 slides down along the track 640. As the button 620 slides downwards, the latch 645 forces the pin 650 downward and rotates the cam 615 against the bias of the resilient member 625. Rotating the cam 615 against the bias of the resilient member 625 enlarges a gap 660 between the projection 635 and the toothed cam surface 630, allowing a user to move the cable 126 through the opening 655. As such, a user may extend the cable 126 by pulling the cable 126 out of the opening 655. Once a desired length has been reached, the user may then release the button 620 to secure the second end 126B of the cable 126 between the projection 635 and the cam 615.

Figure 17A:
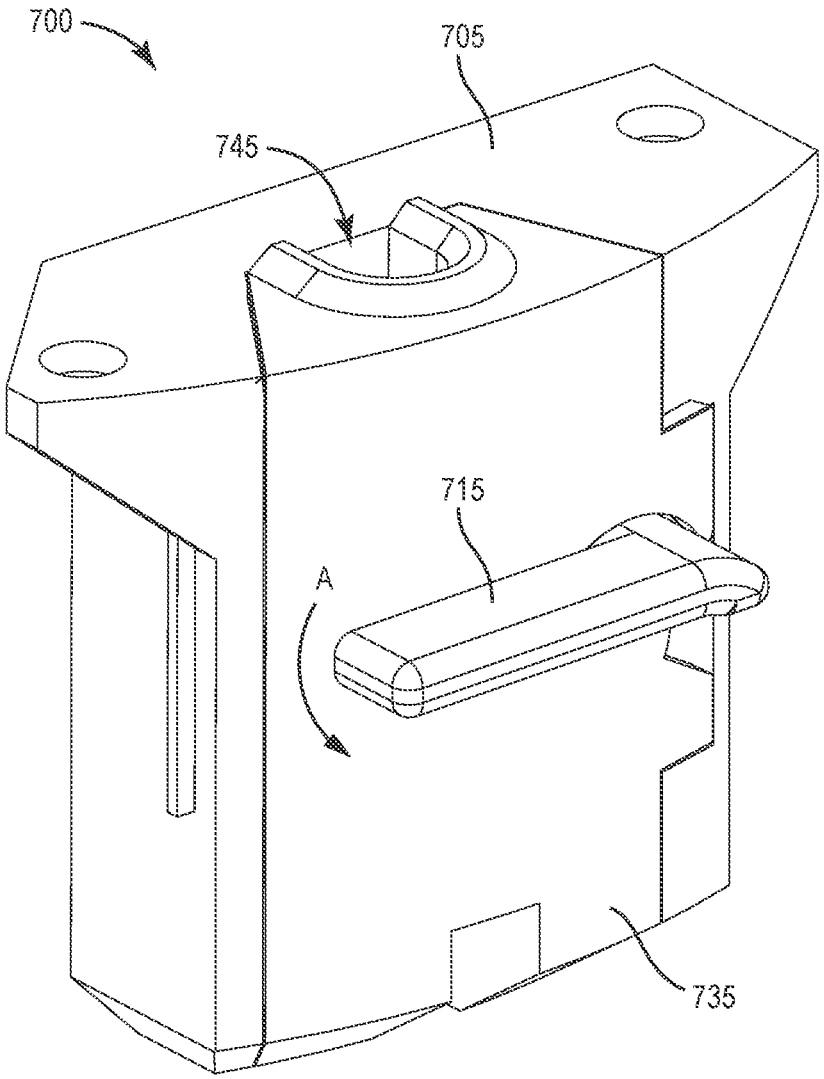
FIG. 17A is a perspective view of another cable clamp mechanism for use with a portable lighting device.
Figure 17B:
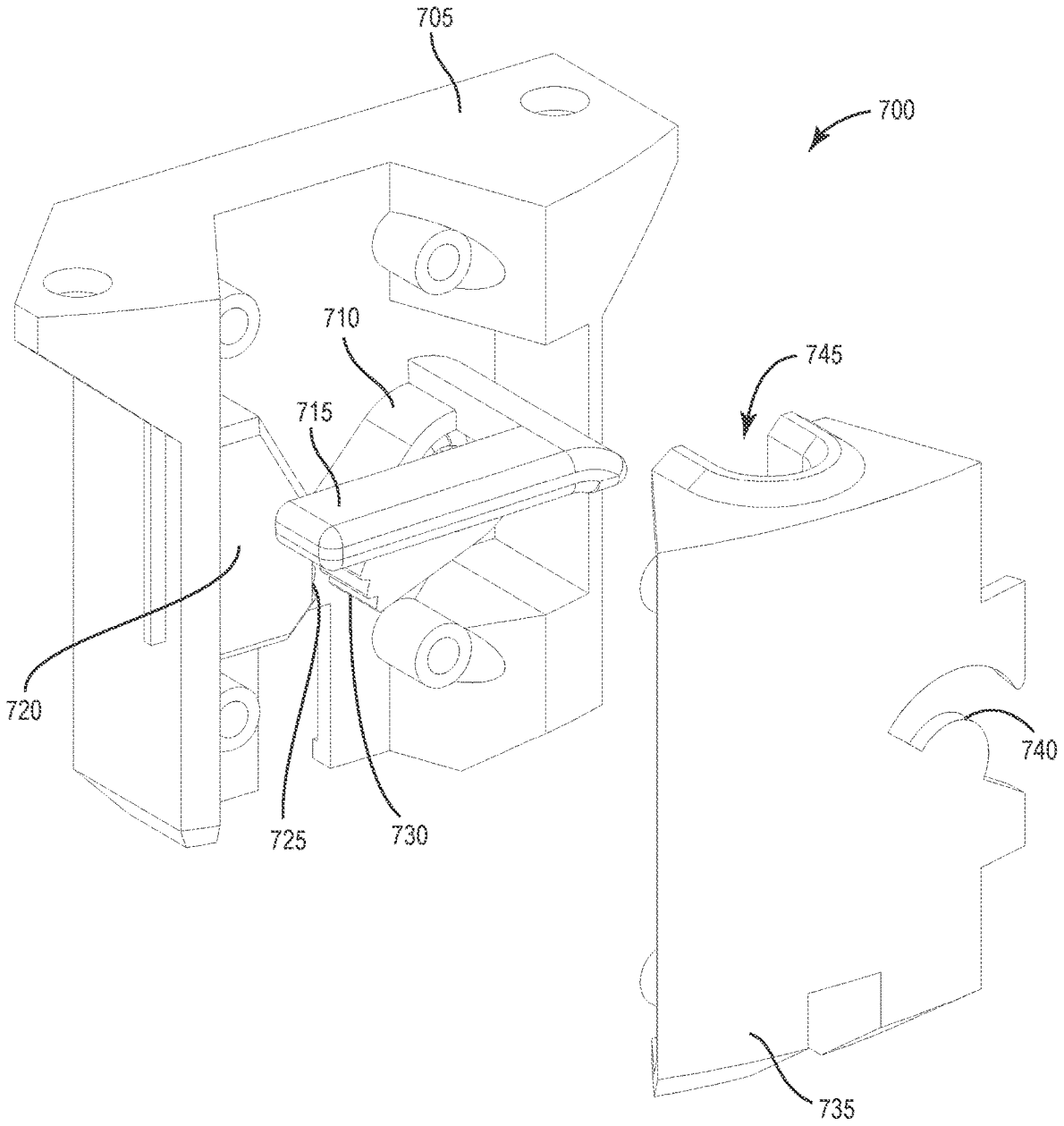
FIG. 17B is a perspective view of the cable clamp mechanism of FIG. 17A with a cover exploded away.
Figure 17C:
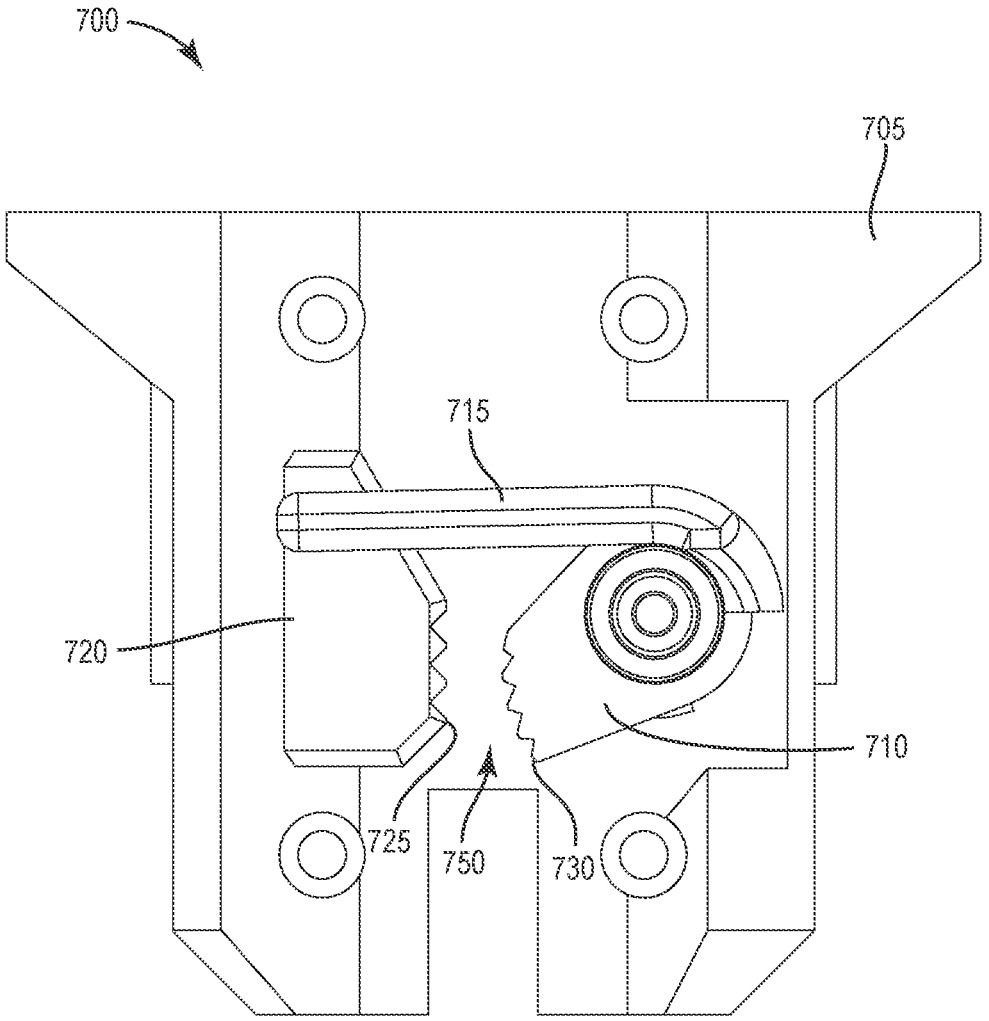
FIG. 17C is a side view of the cable clamp mechanism of FIG. 17A with the cover removed.

FIGS. 17A-17C illustrate another cable clamp mechanism 700 for use with the device 10. The cable clamp mechanism 700 is similar to the cable clamp mechanism 600 with like features being represented with like reference numerals. The illustrated cable clamp mechanism 700 includes a housing 705, a cam 710 supported by the housing 705, and a lever 715 coupled to the cam 710. The housing 705 includes a projection 720 having a toothed surface 725 that faces the cam 710. The cam 710 also includes a toothed surface 730. In the illustrated embodiment, the lever 715 is integral with the cam 710. In other embodiments, the lever 715 may be removably or permanently coupled to the cam 710. The lever 715, or actuator, is actuatable by a user to pivot or rotate the cam 710 relative to the housing 705. In some embodiments, the cam 710 and the lever 715 may be biased to rotate in one direction by, for example, a torsion spring.

The illustrated clamp mechanism 700 further includes a cover 735. The cover 735 is coupled to the housing 705 and at least partially covers the cam 710. The cover 735 defines an arcuate slot 740 through which the lever 715 extends. The arcuate slot 740 guides movement of the lever 715. The cover 735 also defines an opening 745 between an upper portion of the cover 735 and the housing 705. The opening 745 receives the cable 126 to thread the cable 126 through the clamp mechanism 700.

In operation, the second end 126B of the cable 126 extends through the opening 745 and into the clamp mechanism 700 between the projection 720 on the housing 705 and the cam 710. The second end 126B of the cable 126 is then clamped between the toothed surface 725 of the projection 720 and the toothed surface 730 of the cam 710. The cam 710 inhibits the cable 126 from moving in one direction relative to the housing 705. For example, a user may tighten (e.g., shorten) the cable 126 by pulling the cable 126 further through the housing 705 (i.e., downward in the figures). Movement of the cable 126 in a downward direction temporarily rotates the cam 710 away from the projection 720 against the bias of the torsion spring. However, the cam 710 inhibits the cable 126 from being pulled in the other direction (i.e., upward in the figures) to loosen (e.g., lengthen) the cable 126.

A user may lengthen the cable 126 by rotating the lever 715, and thereby the cam 710, against the bias of the torsion spring. In particular, the lever 715 is rotatable by a user in the direction of arrow A (FIG. 17A) to rotate the cam 710 away from the projection 720. Rotating the cam 710 in this direction enlarges a gap 750 between the projection 720 and the cam 710, allowing the user to pull the cable 126 out through the opening 745. Once a desired length of cable 126 has been reached, the user releases the lever 715, causing the cam 710 to rotate back toward the projection 720 and clamp the cable 126 between the toothed surfaces 725, 730.

Figure 18A:
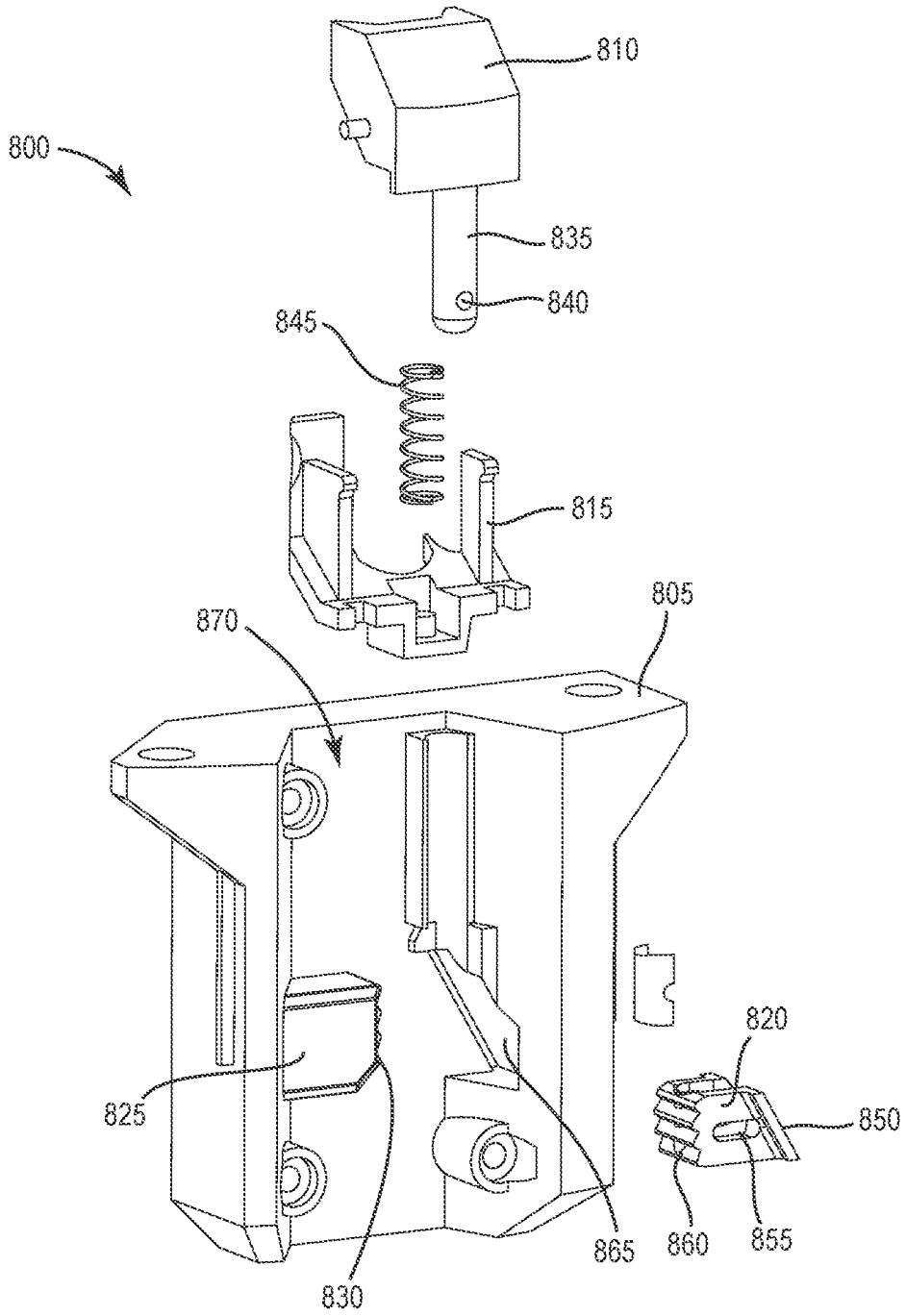
FIG. 18A is a partially exploded view of another cable clamp mechanism for use with the portable lighting device.
Figure 18B:
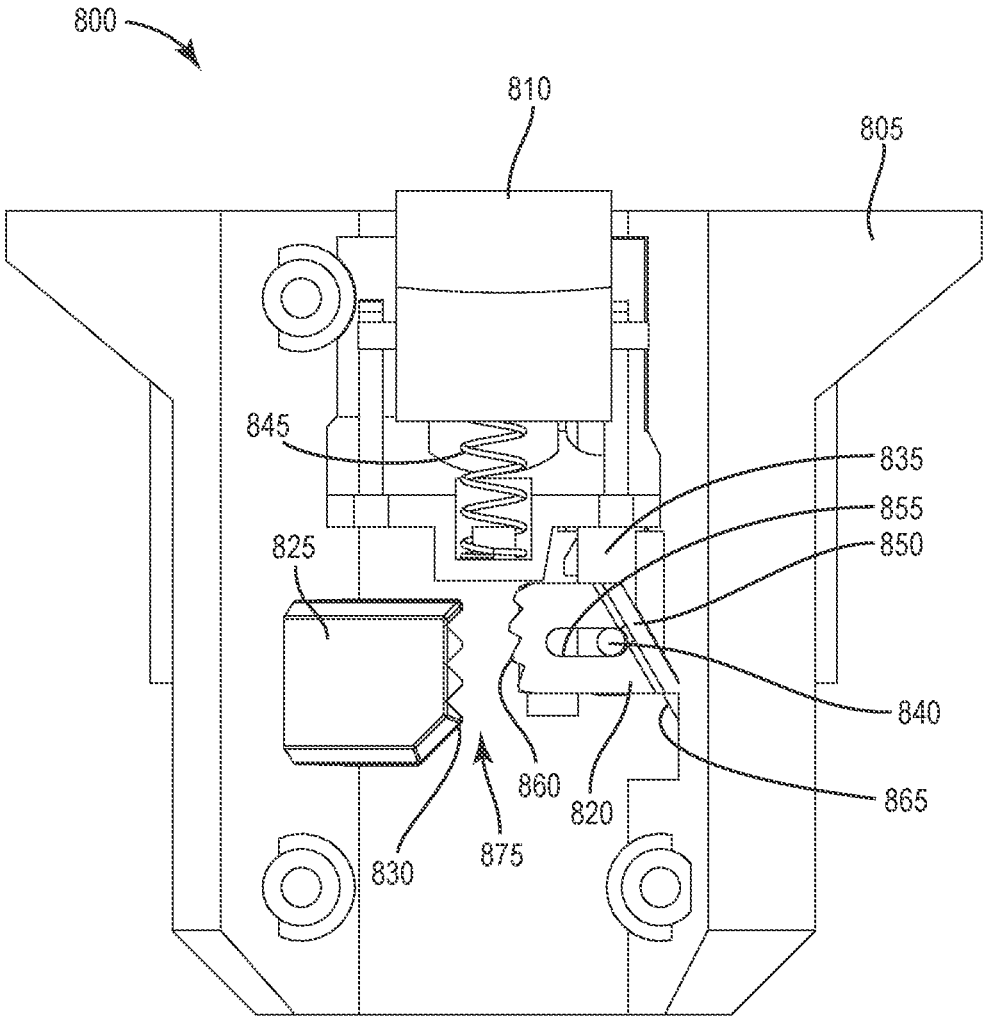
FIG. 18B is a side view of the cable clamp mechanism of FIG. 18A with a cover removed.

FIGS. 18A and 18B illustrate another cable clamp mechanism 800 for use with the device 10. The cable clamp mechanism 800 is similar to the cable clamp mechanism 600 with like features being represented with like reference numerals. The illustrated cable clamp mechanism 800 includes a housing 805, a cover (not shown), a button 810, a track 815 supported by the housing 805, and a slidable cam 820. The housing 805 includes a projection 825 having a toothed surface 830 that faces the cam 820. The button 810, or actuator, is slidable within the track 815 and includes a stem 835 that couples to the cam 820 with a pin 840. A resilient member 845 biases the button 810 away from the track 815 and out of the housing 805. The button 810 is depressible against the resilient member 845 to move the cam 820 relative to the housing 805.

The illustrated cam 820 includes an inclined surface 850, a slot 855 that the pin 840 extends through to couple the cam 820 to the stem 835, and a toothed surface 860. A resilient member (e.g., compression spring) biases the inclined surface 850 of the cam against an inclined surface 865 of the housing 805. The housing 805 at least partially defines an opening 870 between an upper portion of the cover and the housing 805. The opening 870 receives the cable 126 to thread the cable 126 through the clamp mechanism 800.

In operation, the second end 126B of the cable 126 extends through the opening 870 and into the clamp mechanism 800 between the projection 825 on the housing 805 and the cam 820. The second end 126B of the cable 126 is then clamped between the toothed surface 830 of the projection 825 and the toothed surface 860 of the cam 820. The cam 820 inhibits the cable 126 from moving relative to the housing 805.

A user may lengthen the cable 126 by pressing the button 810 downwards along the track 815, causing the inclined surface 850 of the cam 820 to slide along the inclined surface 865 of the housing 805. The bias of the compression spring forces the inclined surface 850 of the cam 820 to engage the inclined surface 865 of the housing 805, allowing the cam 820 to slide on the pin 840 and away from the projection 825 to enlarge a gap 875 between the projection 825 and the cam 820. A user may then pull the cable 126 in or out of the housing 805 through the opening 870. Once the cable 126 is at a desired length, a user may release the button 810. The resilient member 845 biases the button 810 upwards out of the housing 805, drawing the cam 820 upwards and causing the inclined surface 865 of the housing 805 to push the toothed cam surface 860 against the bias of the compression spring towards the toothed surface 830 of the projection 825 to secure the cable 126 again.

Figure 19:
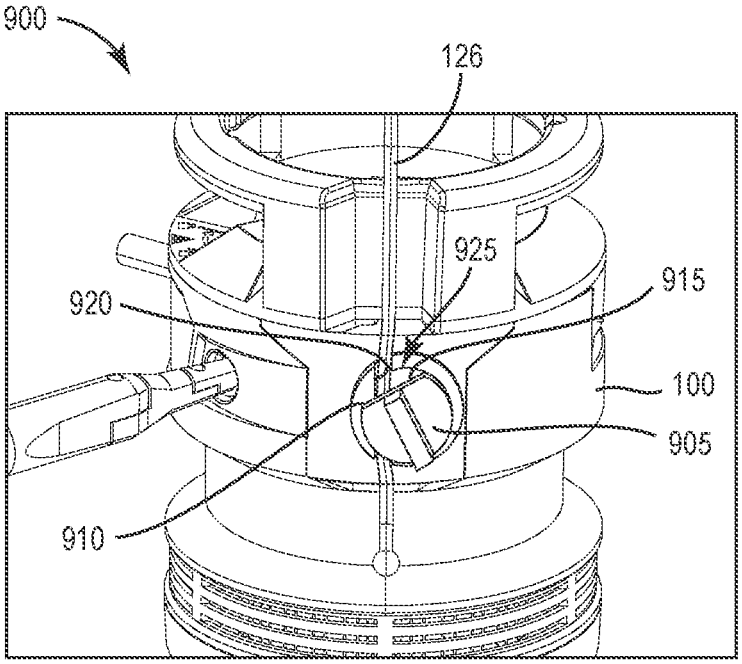
FIG. 19 is a side view of another cable clamp mechanism for use with a portable lighting device.

FIG. 19 illustrates another cable clamp mechanism 900 for use with the device 10. The cable clamp mechanism 900 is similar to the cable clamp mechanism 120 with like features being represented with like reference numerals. The cable clamp mechanism 900 is positioned at a similar location as the cable clamp mechanism 120 and selectively secures the second end 126B of the cable 126. The illustrated cable clamp mechanism 900 includes a rotatable knob 905, or actuator, with an abutment 910 and a resilient member 915. The resilient member 915 biases the abutment 910 of the knob 905 to engage an abutment 920 of the body 100.

To secure the second end 126B of the cable 126, a user rotates the knob 905 against the bias of the resilient member 915 to enlarge a gap 925 for the cable 126 to pass through. Once the cable 126 is within the gap 925, a user then releases the knob 905 allowing the resilient member 915 to rotate the knob 905 and secure the cable 126 between the abutments 910, 920. In the illustrated embodiment, the resilient member 915 is a torsion spring; although in other embodiments the resilient member 915 may be other types of springs. The resilient member 915 biases the knob 905 in a clockwise direction and thus a user rotates the knob 905 counter-clockwise to allow the cable 126 into the gap 925. Alternatively, the resilient member 915 may bias the knob 905 counter-clockwise.

Figure 20:
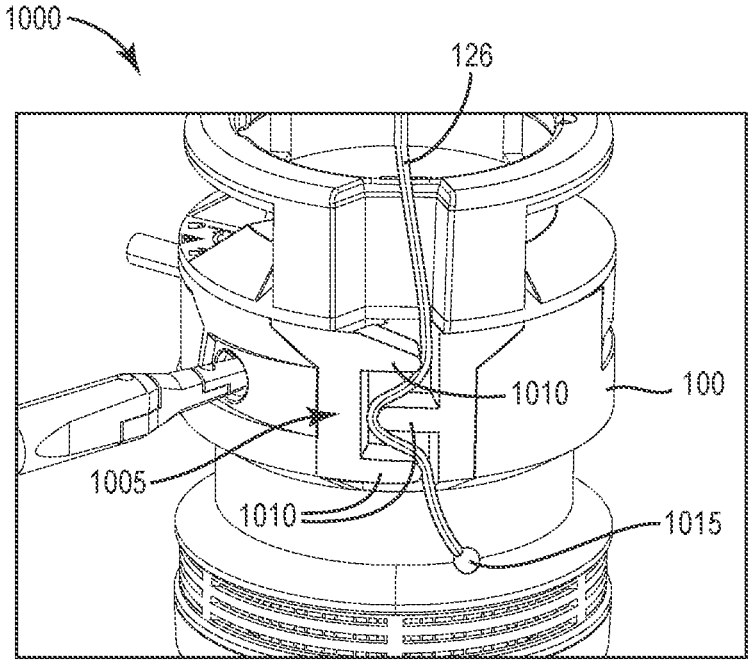
FIG. 20 is a side view of another cable clamp mechanism for use with a portable lighting device.
Figure 21A:
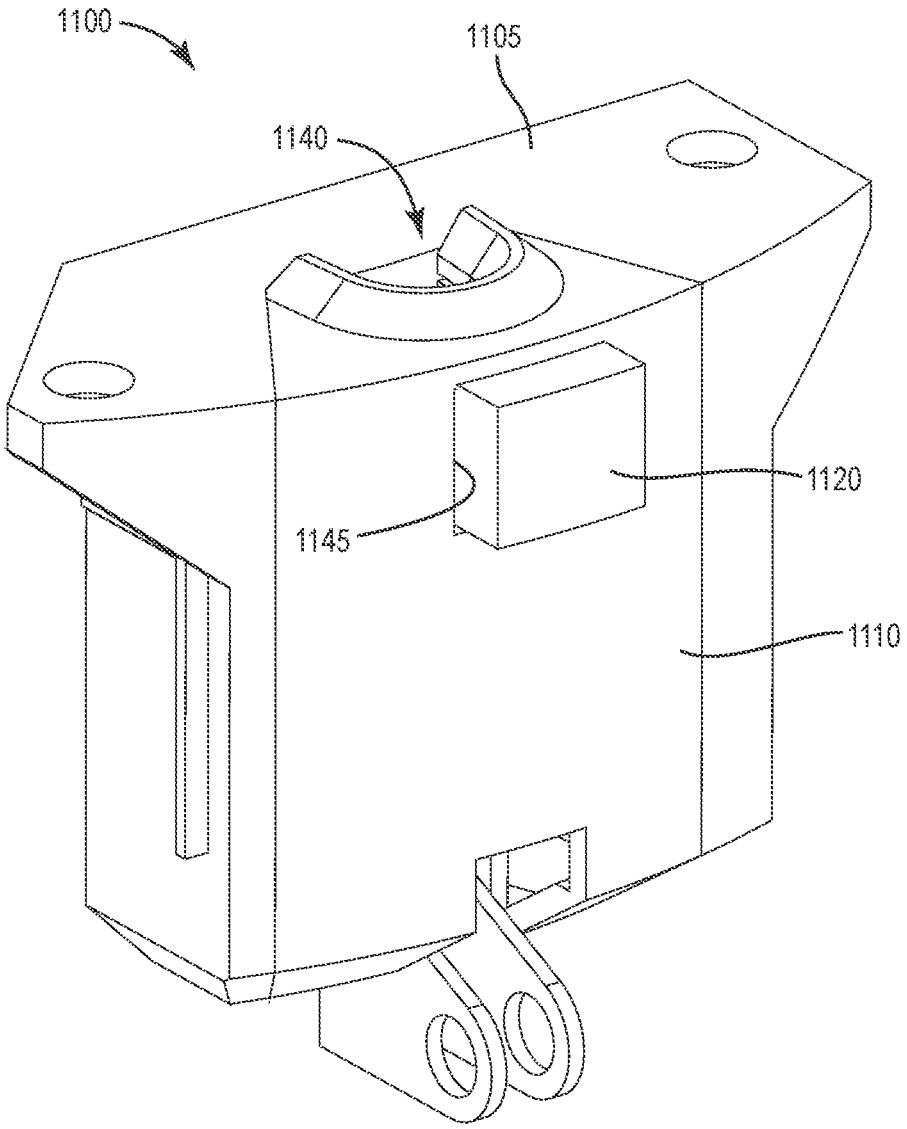
FIG. 21A is a perspective view of another cable clamp mechanism for use with a portable lighting device.
Figure 21B:
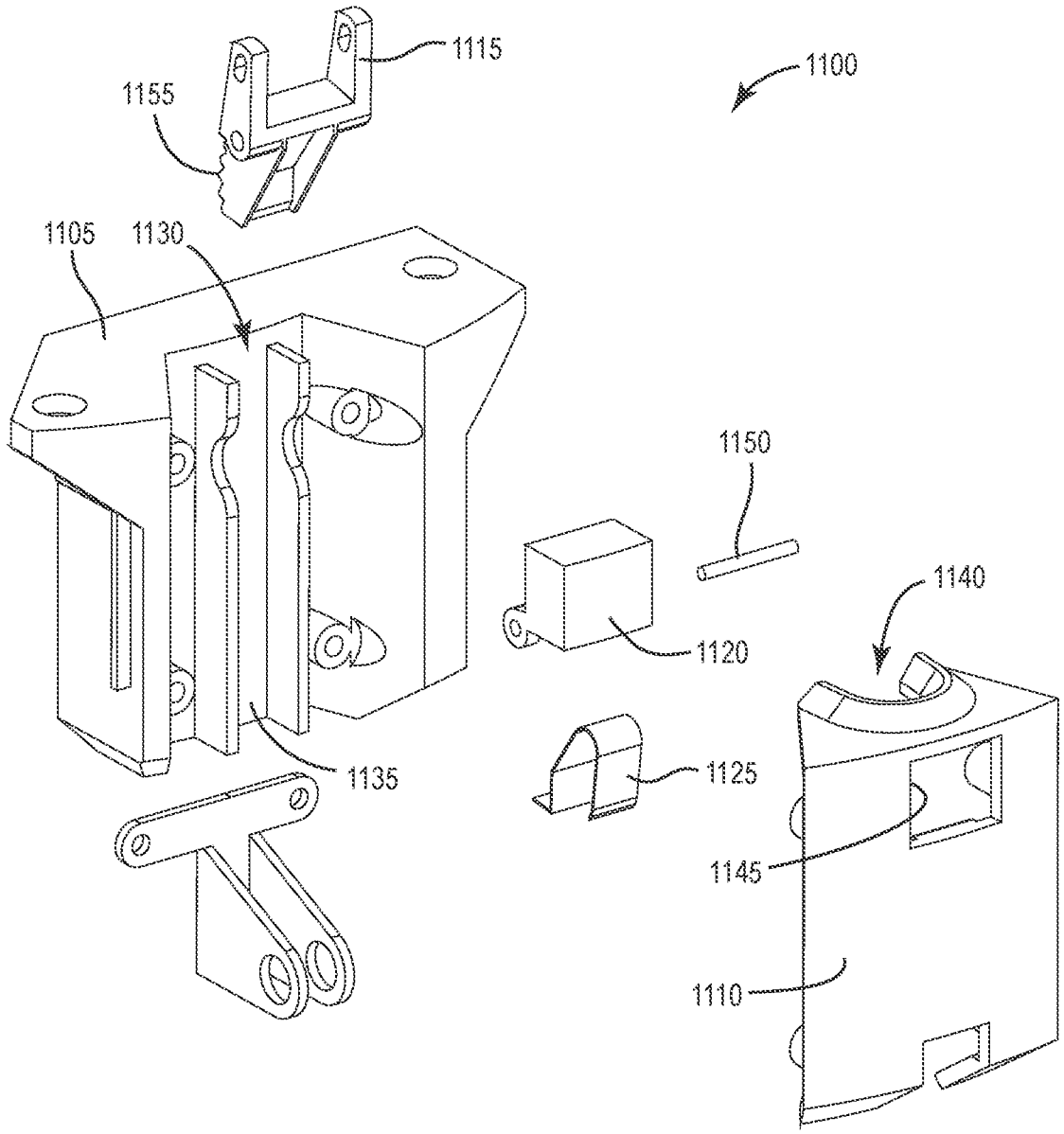
FIG. 21B is an exploded view of the cable clamp mechanism of FIG. 21A.
Figure 21C:
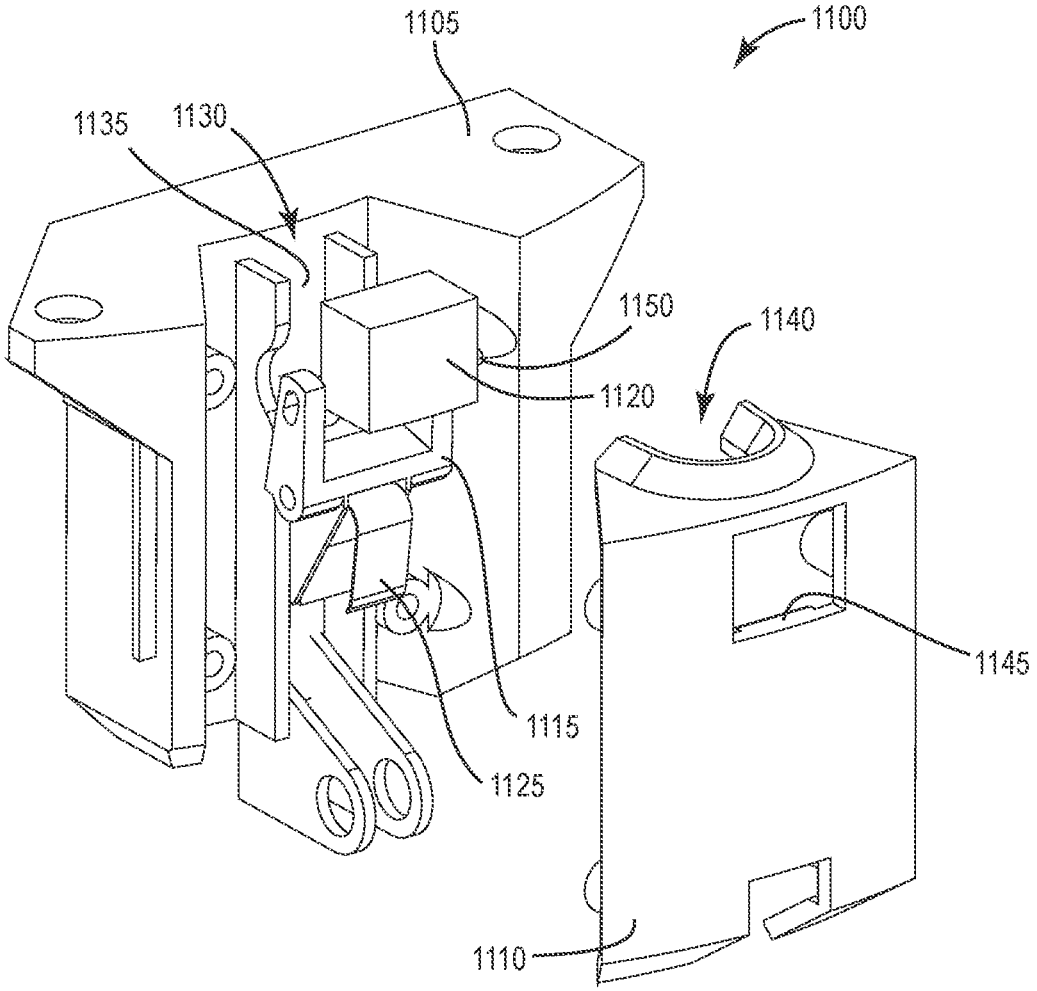
FIG. 21C is another perspective view of the cable clamp mechanism of FIG. 21A with a cover exploded away.
Figure 21D:
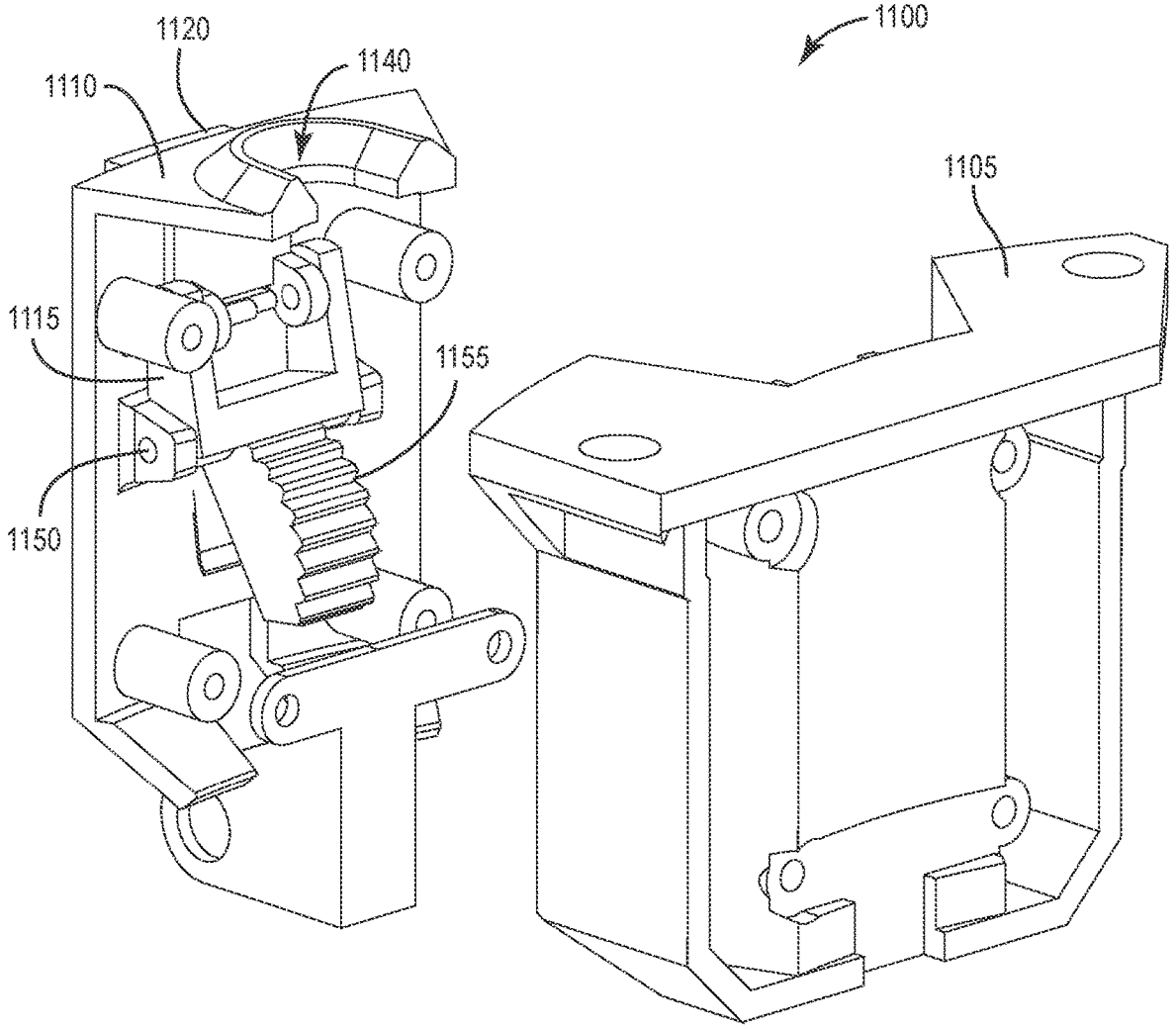
FIG. 21D is another perspective view of the cable clamp mechanism of FIG. 21A with a housing exploded away.

FIG. 20 illustrates a cable clamp mechanism 1000 for use with the device 10. The cable clamp mechanism 1000 is similar to the cable clamp mechanism 120 with like features being represented with like reference numerals. The cable clamp mechanism 1000 is positioned at a similar location as the cable clamp mechanism 120 and selectively secures the second end 126B of the cable 126. The illustrated cable clamp mechanism 1000 includes a cleat 1005 with a plurality of offset steps 1010. The cable 126 is weaved through the cleat 1005, allowing the offset steps 1010 to provide pressure and secure the cable 126 in place. A ball 1015 coupled to the second end 126B of the cable 126 inhibits the cable 126 from passing entirely through the cleat 1005. The length of the cable 126 can be adjusted by taking the cable 126 out of the cleat 1005 and repositioning the cable 126 at a desired length back in the cleat 1005.

FIGS. 21A-21D illustrate another cable clamp mechanism 1100 for use with the device 10. The cable clamp mechanism 1100 is similar to the cable clamp mechanism 600 with like features being represented with like reference numerals. The illustrated cable clamp mechanism 1100 includes a housing 1105, a cover 1110, a pivotable cam member 1115, a button 1120, and a resilient member 1125. The housing 1105 defines a channel 1130 that includes a smooth surface 1135 that faces the cover 1110. The cover 1110 is coupled to the housing 1105 and at least partially covers the cam member 1115. The cover 1110 defines an opening 1140 between an upper portion of the cover 1110 and the housing 805. The opening 1140 receives the cable 126 to thread the cable 126 through the cable clamp mechanism 1100. The cover 1110 further includes an opening 1145 on the front side that the button 1120 extends through and is actuatable by a user to pivot the cam member 1115.

In the illustrated embodiment, the cam member 1115 is coupled to the button 1120, or actuator, with a pin 1150. The cam member 1115 is pivotable relative to the housing 1105 about the pin 1150. The cam member 1115 includes a toothed surface 1155 that faces the smooth surface 1135. The resilient member 1125 biases the toothed surface 1155 of the cam member 1115 against the smooth surface 1135 of the housing 1105. In the illustrated embodiment, the resilient member 1125 is a spring plate, although in other embodiments, the resilient member 1125 may be other types of springs.

In operation, the second end 126B of the cable 126 extends through the opening 1140 and into the clamp mechanism 1100 between the cam member 1115 and the housing 1105. The cam 1115 inhibits movement of the cable 126 from moving in one direction relative to the housing 1105. For example, a user may tighten (e.g., shorten) the cable 126 by pulling the cable 126 further through the housing 1105 (i.e., downward in the figures). Movement of the cable 126 in a downward direction temporarily pivots the cam member 1115 away from the smooth surface 1135 of the housing 1105 against the bias of the resilient member 1125. However, the cam member 1115 inhibits the cable 126 from being pulled in the other direction (i.e., upward in the figures) to loosen (e.g., lengthen) the cable 126.

A user may lengthen the cable 126 by actuating the button 1120, and thereby pivoting the cam member 1115 against the bias of the resilient member 1125. In particular, the button 1120 is depressible by a user to pivot the cam member 1115 away from the housing 1105. Pivoting the cam member 1115 enlarges a gap between the smooth surface 1135 of the housing 1105 and the toothed surface 1155 of the cam member 1115, allowing the user to pull cable 126 through the opening 1140. Once a desired length of cable 126 has been reached, the user may release the button 1120, causing the cam 1115 to pivot back towards the housing 1105 and clamp the cable 126 between the surfaces 1135, 1155.

In the illustrated embodiment, the maximum power input from an AC source for the device 10 is 125 Watts (W) at just over 1 Amp (A). Preferably, the power input from an AC source is within a range between 115 W and 125 W for 115-120 Volts (V) AC. With such an input, the light output is within a range between 15,000 and 18,000 Lumens. Preferably, the light output is 15,900 Lumens. In the illustrated embodiment, the device 10 produces a ratio of the light emitted (Lumens) divided by the power (Watts) that is greater than 117 L/W. Preferably, the ratio is in a range between 120 L/W and 155 L/W. Additionally, the device 10 produces a ratio of the light emitted divided by the voltage output (Volts) that is in a range between 150 L/V and 160 L/V.

Figure 22:
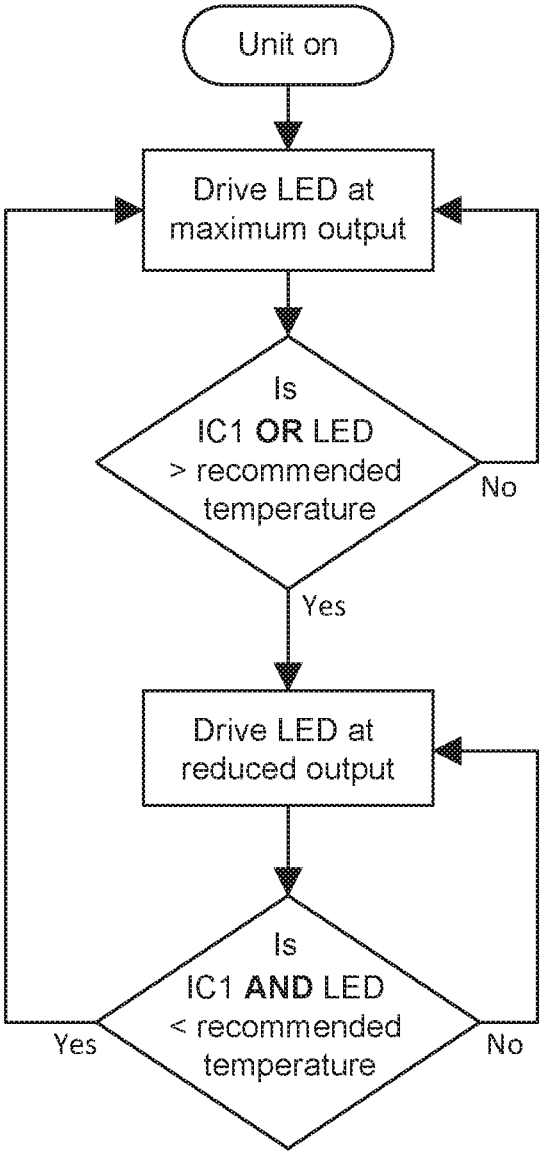
FIG. 22 is a flowchart of the operation of an LED on the portable lighting device.

In the illustrated embodiments, the portable lighting device 10 includes an integrated circuit board with a processor that controls the operation of the portable lighting device 10. For example, the processor may control power to the terminal block 200 or to the LEDs 25. As shown in FIG. 22, the processor controls the output of the LEDs 25. When power is first supplied to the portable lighting device 10, the processor drives the LEDs 25 at a maximum output (e.g., 1.33 amps). The processor continuously checks the temperature of the integrated circuit board and the LEDs 25. If either the integrated circuit board or the LEDs 25 are below a first recommended temperature (e.g., 105° C.), the processor continues to drive the LEDs 25 at the maximum output. However, if either the integrated circuit board or the LEDs 25 is above the first recommended temperature, the processor drives the LEDs 25 at a reduced output (e.g., about 70% of the maximum output, or 0.94 amps). The processor then checks the temperature of the integrated circuit board and the LEDs 25 again. If either the integrated circuit board or the LEDs 25 are above a second recommended temperature (e.g., 95° C.), the processor continues to drive the LEDs 25 at the reduced output. Alternatively, if both the integrated circuit board and the LEDs 25 are below the second recommended temperature, the processor drives the LEDs 25 at the maximum output. In some embodiments, the first recommended temperature and the second recommended temperature are different temperatures. In other embodiments, the first and second recommended temperatures are the same temperature.

Although the invention has been described in detail with reference to certain preferred embodiments, variations and modifications exist within the scope and spirit of one or more independent aspects of the invention as described.

What is claimed is:

1. A portable lighting device comprising:

a body having an interior cavity;

a lighting unit supported by the body, the lighting unit including a light emitting diode;

a terminal block supported within the interior cavity of the body, the terminal block configured to connect to a power source and provide electrical energy to the lighting unit to illuminate the light emitting diode;

a port formed in the body in communication with the interior cavity, the port configured to allow an electrical wire to pass into the interior cavity to couple the electrical wire to the terminal block; and a wire clamp supported by the body at the port, the wire clamp including a single actuator and a clamp, the single actuator being selectively movable relative to the body to move the clamp into engagement with the electrical wire passing through the port.

2. The portable lighting device of claim 1, wherein the single actuator is a threaded fastener.

3. The portable lighting device of claim 2, wherein rotation of the threaded fastener in a first direction moves the clamp to engage the electrical wire.

4. The portable lighting device of claim 1, wherein the port defines a bottom plate, and wherein the electrical wire is secured between the clamp and the bottom plate.

5. The portable lighting device of claim 1, wherein the port is a first port and the wire clamp is a first wire clamp, and further comprising:

a second port defined in the body in communication with the interior cavity and spaced apart from the first port, the second port configured to allow another electrical wire to pass into the interior cavity to couple the another electrical wire to the terminal block; and a second wire clamp supported by the body at the second port, the second wire clamp being selectively movable relative to the body to engage the another electrical wire passing through the second port.

6. The portable lighting device of claim 1, wherein the terminal block receives a maximum power input from an AC source that is between 115 watts and 125 watts.

7. The portable lighting device of claim 1, wherein the light output from the lighting unit is in a range from between 15,000 Lumens and 18,000 Lumens.

8. The portable lighting device of claim 1, wherein a ratio defined by the light emitted by the lighting unit divided by the power provided to the terminal block is greater than 117 Lumens/Watt.

9. The portable lighting device of claim 1, wherein a ratio defined by the light emitted by the lighting unit divided by the voltage output is between 150 Lumens/Volt and 160 Lumens/Volt.

10. The portable lighting device of claim 1, further comprising a hanging cable coupled to the body, the hanging cable configured to hang the body from a support structure.

11. A portable lighting device comprising:

a body including a base having an interior cavity and a cover movably coupled to the base to selectively provide access to the interior cavity;

a lighting unit supported by the body, the lighting unit including a light emitting diode;

a terminal block supported within the interior cavity of the body, the terminal block configured to connect to a power source and provide electrical energy to the lighting unit to illuminate the light emitting diode; and a cover locking mechanism supported by the body that engages the base to maintain the cover in a closed configuration, the cover locking mechanism including an actuator to selectively allow the cover to move to an open configuration, the actuator accessible by inserting a tool through a hole in the cover.

12. The portable lighting device of claim 11, wherein the cover locking mechanism further includes a latch to secure the lighting device in the closed configuration.

13. The portable lighting device of claim 12, wherein the latch is biased by a resilient member to secure the cover in the closed configuration.

14. The portable lighting device of claim 11, further comprising a hanging cable coupled to the body, the hanging cable configured to hang the body from a support structure.

15. A portable lighting device comprising:

a body;

a lighting unit supported by the body, the lighting unit including a light emitting diode;

a hanging cable configured to hang the body from a support structure, the hanging cable having a first end secured to the body and a second end portion opposite the first end; and a cable clamp mechanism supported by the body, the cable clamp mechanism engaging the second end portion of the hanging cable to secure the hanging cable relative to the body, the cable clamp mechanism including a manual actuator to disengage the cable clamp mechanism to allow adjustment of a length of the hanging cable between the first end and the cable clamp mechanism.

16. The portable lighting device of claim 15, wherein the manual actuator is a button.

17. The portable lighting device of claim 15, wherein the cable clamp mechanism includes a housing that defines an opening that the second end portion of the hanging cable extends through.

18. The portable lighting device of claim 15, wherein the manual actuator is a lever.

19. The portable lighting device of claim 15, wherein the cable clamp mechanism includes a toothed cam to engage the second end portion of the hanging cable to secure it relative to the body.

20. The portable lighting device of claim 15, wherein the hanging cable forms a loop between the first end and the second end portion that is configured to hang the body from a support structure.

* * * * *